US006874416B2

(12) United States Patent
Fukushima et al.

(10) Patent No.: US 6,874,416 B2
(45) Date of Patent: Apr. 5, 2005

(54) PRINTING PRESS

(75) Inventors: Syuji Fukushima, Chiba (JP); Akehiro Kusaka, Chiba (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 10/305,236

(22) Filed: Nov. 27, 2002

(65) Prior Publication Data

US 2003/0097944 A1 May 29, 2003

(30) Foreign Application Priority Data

Nov. 27, 2001 (JP) ..... 2001-360416

(51) Int. Cl.[7] ..... B41F 31/00; B41F 31/15

(52) U.S. Cl. ..... 101/350.3; 101/352.06; 101/DIG. 38

(58) Field of Search ..... 101/DIG. 38, 350.3, 101/352.06, 483, 484, 148

(56) References Cited

U.S. PATENT DOCUMENTS

| | | | | | |
|---|---|---|---|---|---|
| 2,030,351 | A | * | 2/1936 | Syndey | 101/211 |
| 4,513,663 | A | * | 4/1985 | Hummel et al. | 101/350.3 |
| 5,142,979 | A | * | 9/1992 | Funada et al. | 101/183 |
| 5,619,922 | A | * | 4/1997 | Kelm | 101/216 |
| 5,713,280 | A | | 2/1998 | Kim et al. | |
| 5,813,344 | A | * | 9/1998 | Maruyama et al. | 101/424 |
| 6,498,445 | B2 | * | 12/2002 | Fujiwara et al. | 318/119 |
| 6,578,481 | B1 | * | 6/2003 | Beisel et al. | 101/350.3 |
| 6,634,292 | B2 | * | 10/2003 | Fujiwara et al. | 101/141 |
| 2001/0009358 | A1 | | 7/2001 | Fujiwara et al. | |
| 2002/0005127 | A1 | | 1/2002 | Fujiwara et al. | |
| 2002/0014172 | A1 | | 2/2002 | Fujiwara et al. | |

FOREIGN PATENT DOCUMENTS

| | | | | |
|---|---|---|---|---|
| EP | 0444225 | A1 | 9/1991 | |
| EP | 924072 | A1 * | 6/1999 | B41F/31/15 |
| JP | 2875856 | B2 | 1/1999 | |

* cited by examiner

*Primary Examiner*—Andrew H. Hirshfeld
*Assistant Examiner*—Leo T. Hinze
(74) *Attorney, Agent, or Firm*—Birch, Stewart, Kolasch & Birch, LLP

(57) ABSTRACT

A printing press comprises an oscillating roller capable of rotating circumferentially and moving axially in a reciprocating manner, and does rainbow printing on a sheet, supplied from a feeder, in a printing unit. The printing press includes an oscillation width control device and an oscillation frequency control device for exercising control such that the oscillating roller moves axially in a reciprocating manner when printing is started in a state in which the axially moving motion of the oscillating roller is at a standstill. The printing press can automatically start the oscillating motion of the ink oscillating roller when printing is started from the state of the oscillating motion of the oscillating roller being stopped at the time of ink conditioning in rainbow printing, thereby decreasing the number of defective sheets and improving the ease of operation.

8 Claims, 22 Drawing Sheets

PRINTING PRESS

The entire disclosure of Japanese Patent Application No. 2001-360416 filed on Nov. 27, 2001 including specification, claims, drawings and summary is incorporated herein by reference in its entirety.

BACKGROUND OF THE INVENTION

1. Field of the Invention

This invention relates to a printing press in which rainbow printing is done in a printing unit on a sheet supplied from a feeder.

2. Description of the Related Art

An inking device of a printing press, which supplies ink to the surface of a printing plate mounted on a plate cylinder, has an ink fountain for storing ink, and a group of rollers for uniformly distributing the ink, which flows out of the ink fountain, in different directions while transferring it. The ink transferred to an end portion of the group of rollers is supplied to the plate cylinder via an ink form roller.

The inking device for performing such an ink supply action (hereinafter referred to as an inker) rotates the rollers and levels the ink prior to inking the plate surface before printing is carried out. Among the above-mentioned group of rollers, an ink oscillating roller, which acts in a roller rotational axis direction (a lateral direction), is disposed for distributing ink during printing as well as ink conditioning. Driving for the ink oscillating roller has hitherto been linked to driving for the inker, and when the inker is actuated, an oscillating motion also occurs in an interlocked manner.

To prevent forgery or for other purposes, rainbow printing is performed for printing in inks of two or more colors placed on the same plate surface. To realize this rainbow printing, the inker feeds inks of two or more colors onto the same ink roller, and inks with a constant mixed color width are supplied to a sheet. The mixed color width is controlled by keeping an ink film constant based on a balance between the transfer of inks to the sheet and the supply of inks from the ink fountains, and oscillating the ink oscillating roller over a required width. Instability of the ink film results in the instability of the mixed color width.

In rainbow printing, if ink conditioning is performed, the thickness of the ink film on the roller increases, and the mixed color width changes, because no ink is transferred to the sheet. Thus, rainbow printing has generally been done without execution of ink conditioning. That is, the leveled state of ink has been stabilized, with printing started while the sheet is being passed. Some printing presses adopt a manual operation with the use of a mechanism for stopping an oscillating motion. In detail, the oscillation width is set to be 0 mm at the time of ink conditioning, and the oscillation width is returned again to the original value at the time of printing.

Hence, printing presses, which do not carry out ink conditioning, have posed the problem of an increase in the number of defective sheets. Printing presses, which perform a manual operation using a mechanism for stopping an oscillating motion, have presented the problem that the oscillation width has to be adjusted for each ink conditioning and for each printing, inducing an increase in the printing make-ready time.

Japanese Patent No. 2875856 discloses a technique with a dampener in which the oscillating motion of an oscillating rider interlocked with an oscillating roller via a lever and a spring is blocked during inspection, when no water is supplied, by restraining the lever by moving means comprising an air cylinder and a pin, thereby preventing the interlocking of the oscillating rider with the oscillating roller. This technique may be applied to the inker which does rainbow printing. In this case, however, when ink conditioning is switched to printing, it becomes necessary to actuate the moving means again, thereby releasing the restraint of the lever. Thus, the operation is tiresome. If the operator forgets to perform this operation, the problem arises that the oscillating motion of the ink oscillating roller does not take place, and rainbow printing cannot be achieved.

SUMMARY OF THE INVENTION

The present invention has been accomplished in consideration of the above problems with the earlier technologies. It is the object of the invention to provide a printing press which can automatically start the oscillating motion of the ink oscillating roller when printing is started from the state of the oscillating motion of the oscillating roller being stopped at the time of ink conditioning in rainbow printing, thereby decreasing the number of defective sheets and improving the ease of operation.

As explained concretely based on the embodiments, according to the present invention, there is provided a printing press comprising an oscillating roller capable of rotating circumferentially and capable of moving axially in a reciprocating manner, and in which a sheet supplied from a feeder is subjected to rainbow printing in a printing unit. The printing press includes a control device for exercising control such that the oscillating roller moves along an axial direction thereof in a reciprocating manner when printing is started in a state in which an axial moving motion of the oscillating roller is at a standstill.

According to the above feature, the oscillating motion of the ink oscillating roller can be automatically started when printing is started from the state of the oscillating motion of the oscillating roller being stopped at the time of ink conditioning in rainbow printing, whereby the number of defective sheets can be decreased and the ease of operation improved.

The printing press may be a printing press further comprising an oscillating device for reciprocating the oscillating roller along an axial direction thereof, and wherein the control device controls the oscillating device.

In the printing press, the control device may exercise control so as to stop the axial moving motion of the oscillating roller while the printing press is idling.

In the printing press, the control device may exercise control so as to start axial movement of the oscillating roller based on signals from detection means for detecting the sheet being supplied.

The printing press may be a printing press further comprising a switch, and wherein the control device controls axial movement of the oscillating roller in response to signals from the switch.

In the printing press, the oscillating device may comprise: an oscillating mechanism for reciprocating the oscillating roller along an axial direction thereof; oscillating mechanism drive means for actuating the oscillating mechanism; an oscillation width adjusting mechanism for adjusting an oscillation width of the oscillating roller; and oscillation width adjustment drive means for actuating the oscillation width adjusting mechanism.

The control device may control the oscillation width adjustment drive means such that an oscillation width adjustment amount is reduced to zero, whereby axial movement of the oscillating roller is stopped.

In the printing press, the oscillating device may comprise: an oscillating mechanism for reciprocating the oscillating roller along an axial direction thereof; and oscillating mechanism drive means for actuating the oscillating mechanism.

The control device may stop driving of the oscillating mechanism drive means, thereby stopping axial movement of the oscillating roller.

The printing press may be a printing press further comprising oscillation width inputting means for inputting an oscillation width of the oscillating roller, and wherein the oscillating device includes, an oscillation width adjusting mechanism for adjusting an oscillation width of the oscillating roller, and oscillation width adjustment drive means for actuating the oscillation width adjusting mechanism.

The control device controls actuation of the oscillation width adjustment drive means such that the oscillation width of the oscillating roller is a value inputted by the oscillation width inputting means.

In the printing press, the oscillating device may comprise: an oscillating mechanism for reciprocating the oscillating roller along an axial direction thereof; oscillating mechanism drive means for actuating the oscillating mechanism; an oscillation width adjusting mechanism for adjusting an oscillation width of the oscillating roller; and oscillation width adjustment drive means for actuating the oscillation width adjusting mechanism.

The control device may control actuation of the oscillation width adjustment drive means such that the oscillation width of the oscillating roller is a designated value, and may also exercise control so as to stop the oscillating mechanism drive means while the printing press is idling when the oscillation width designated is smaller than a preset value, whereby axial movement of the oscillating roller is stopped.

In the printing press, the control device may exercise control so as to actuate the oscillating mechanism drive means while the printing press is idling when the oscillation width designated is larger than the preset value, whereby the oscillating roller is axially moved in an reciprocating manner with the oscillation width designated.

The printing press may be a printing press further comprising oscillation width inputting means for inputting the oscillation width of the oscillating roller, and wherein a value inputted by the oscillation width inputting means is the oscillation width designated.

The printing press may be a printing press wherein the oscillating device comprises: an oscillating mechanism for reciprocating the oscillating roller along an axial direction thereof; oscillating mechanism drive means for actuating the oscillating mechanism; an oscillation width adjusting mechanism for adjusting an oscillation width of the oscillating roller; and oscillation width adjustment drive means for actuating the oscillation width adjusting mechanism, the oscillating mechanism drive means being adapted to rotate the oscillating roller circumferentially and move the oscillating roller axially in a reciprocating manner, the printing press further comprising: main drive means for rotating the oscillating roller circumferentially; first engaging/disengaging means for engaging and disengaging a rotational drive from the main drive means to the oscillating roller; and second engaging/disengaging means for engaging and disengaging a rotational drive from the oscillating mechanism drive means to the oscillating roller.

The control device controls the second engaging/disengaging means, the oscillating mechanism drive means, and the oscillation width adjustment drive means in response to signals from the first engaging/disengaging means, thereby stopping axial movement of the oscillating roller.

In the printing press, the control device may exercise control such that when the first engaging/disengaging means is disengaged, the second engaging/disengaging means is engaged, and also the oscillation width adjustment drive means is controlled to reduce an oscillation width adjustment amount to zero, whereby axial movement of the oscillating roller is stopped, and when the first engaging/disengaging means is engaged, the second engaging/disengaging means is disengaged, and also the oscillating mechanism drive means is stopped, whereby axial movement of the oscillating roller is stopped.

In the printing press, the first engaging/disengaging means may be frame moving means which engages and disengages the drive from the main drive means to the oscillating roller by bringing a first frame and a second frame supporting the oscillating roller close to and away from each other.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 1*a* and 1*b* are views showing a first embodiment of the present invention, in which FIG. 1*a* is an external schematic configuration drawing of a double-sided multicolor offset printing press, and FIG. 1*b* is an enlarged view of a hydraulic cylinder;

DESCRIPTION OF THE PREFERRED EMBODIMENTS

Preferred embodiments of the printing press according to the present invention will now be described in detail with reference to the accompanying drawings, which in no way limit the invention.

First Embodiment

Figure 1A:
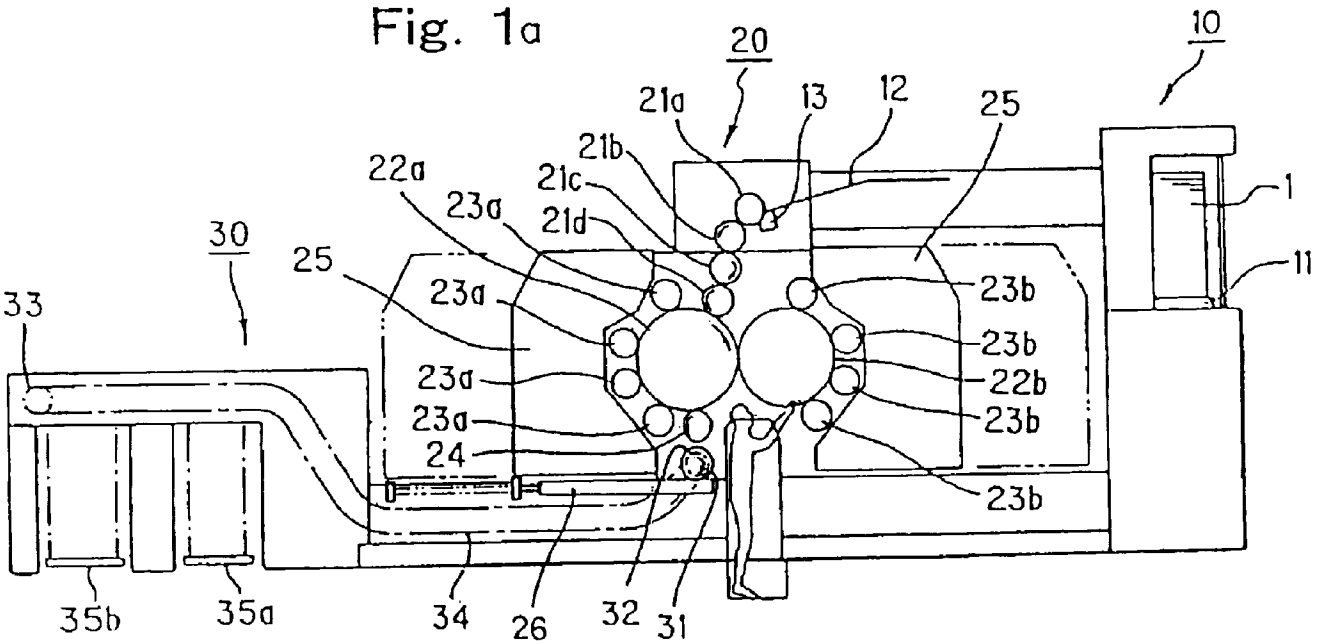
Figure 1B:
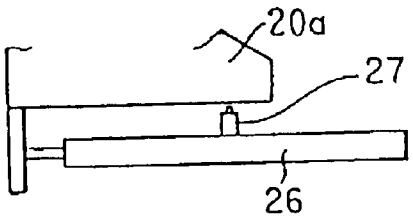
Figure 2:
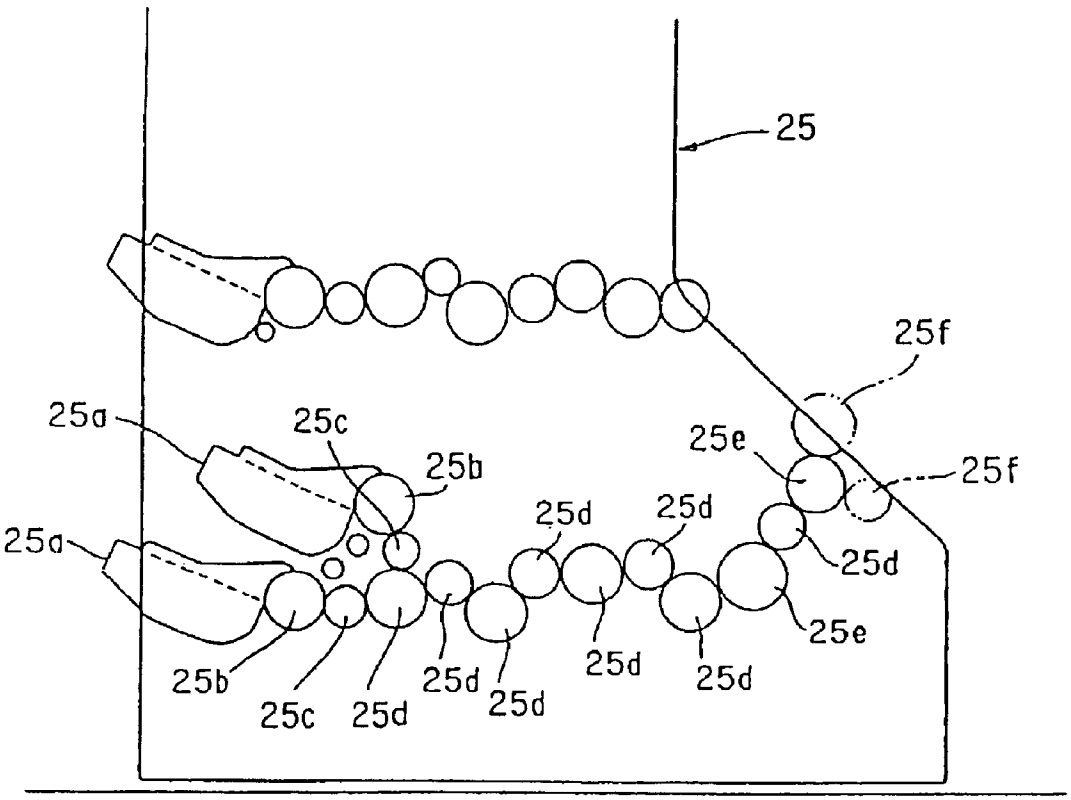
FIG. 2 is an extracted, enlarged view of an inker portion.
Figure 3:
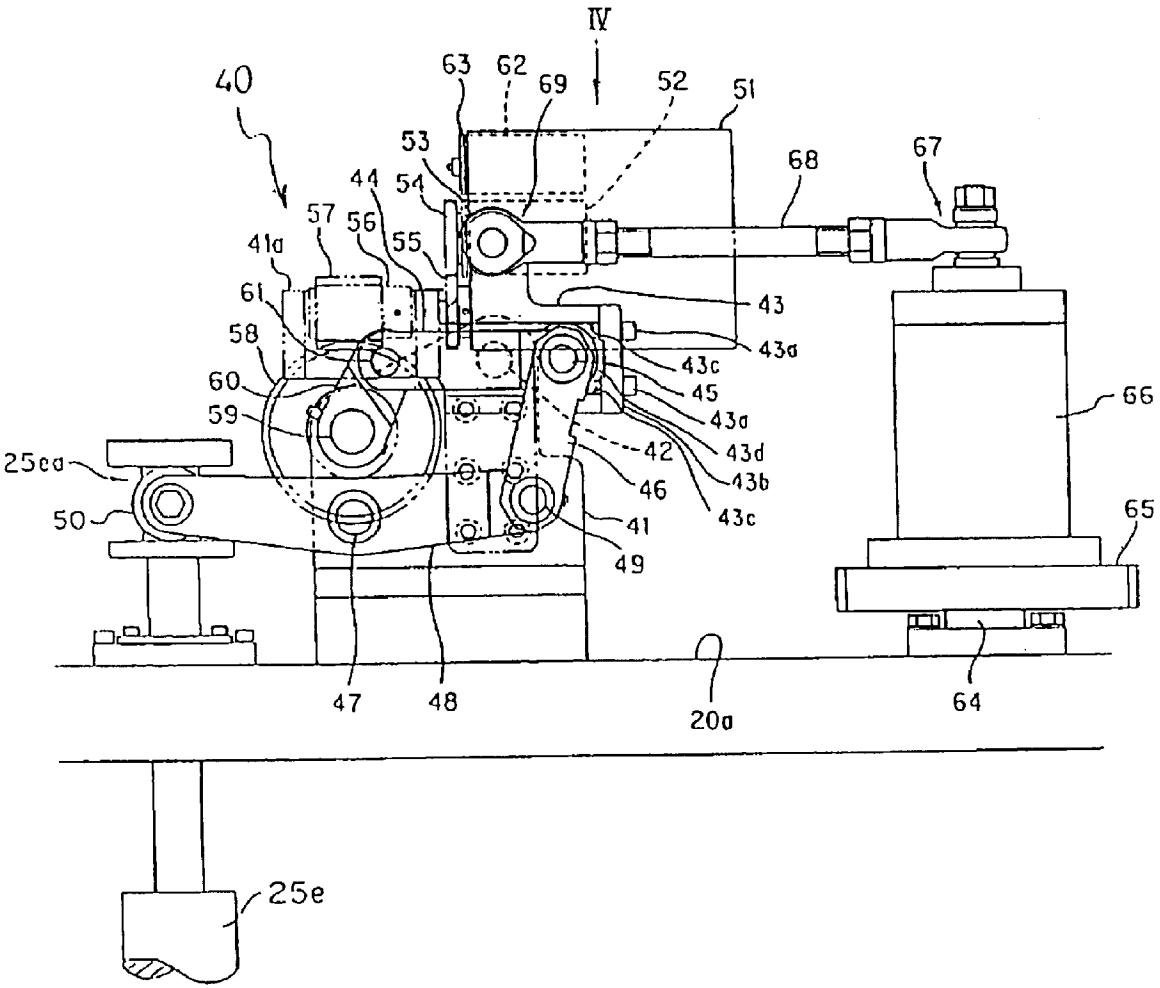
FIG. 3 is a side sectional view showing a schematic structure of the essential parts of an oscillating mechanism for an oscillating roller.
Figure 4:
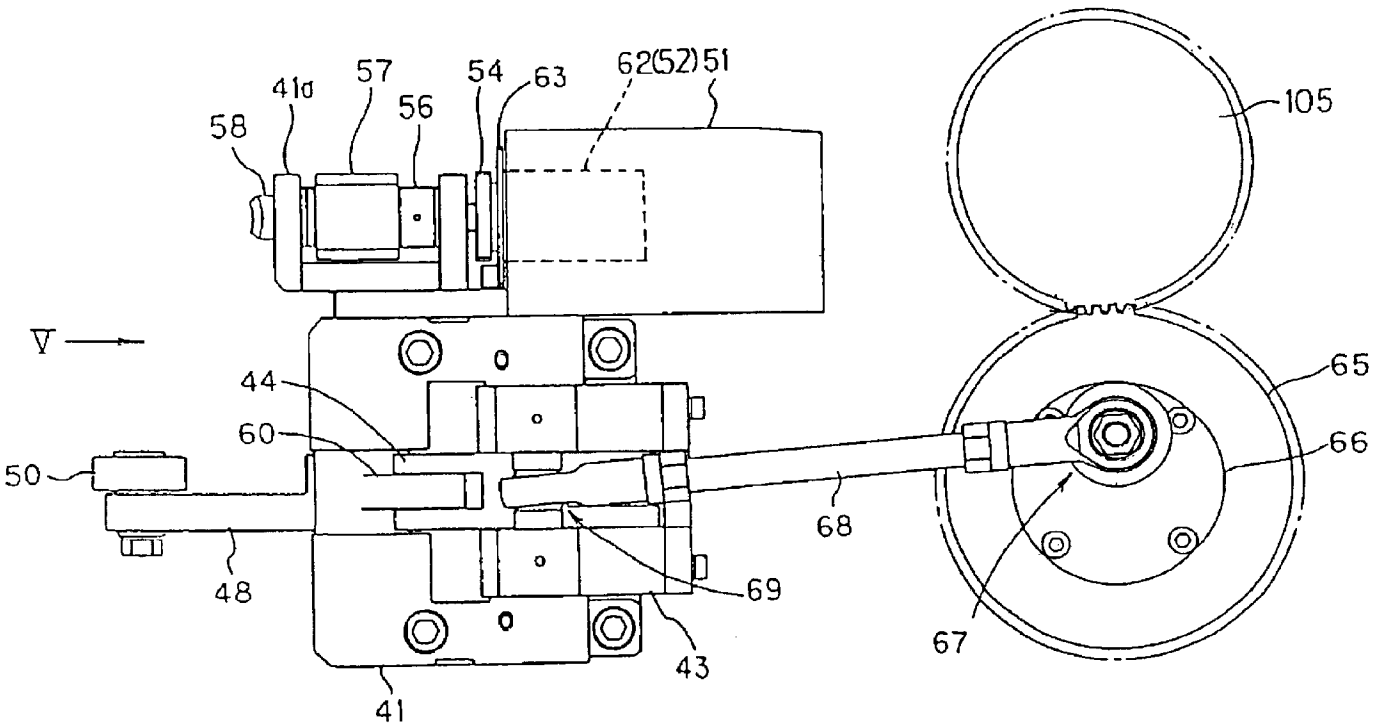
FIG. 4 is a plan view taken along the arrowed line IV of FIG. 3.
Figure 5:
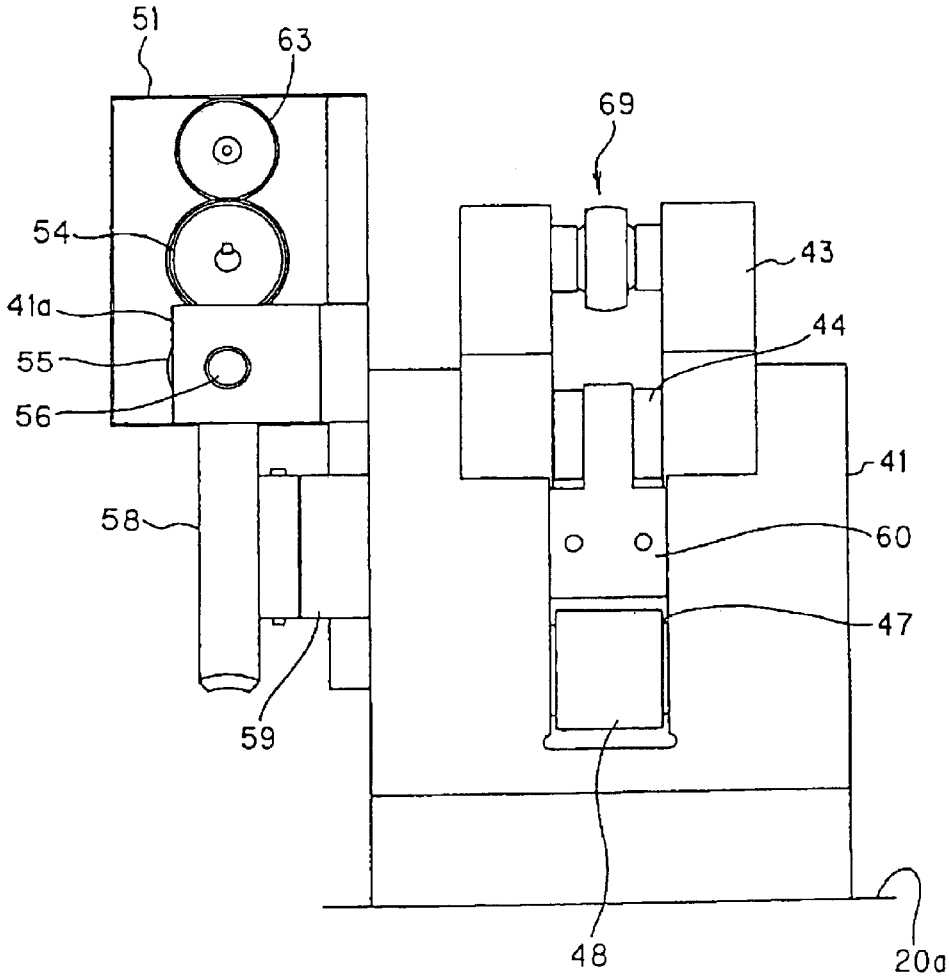
FIG. 5 is a front view taken along the arrowed line V of FIG. 4.
Figure 6:
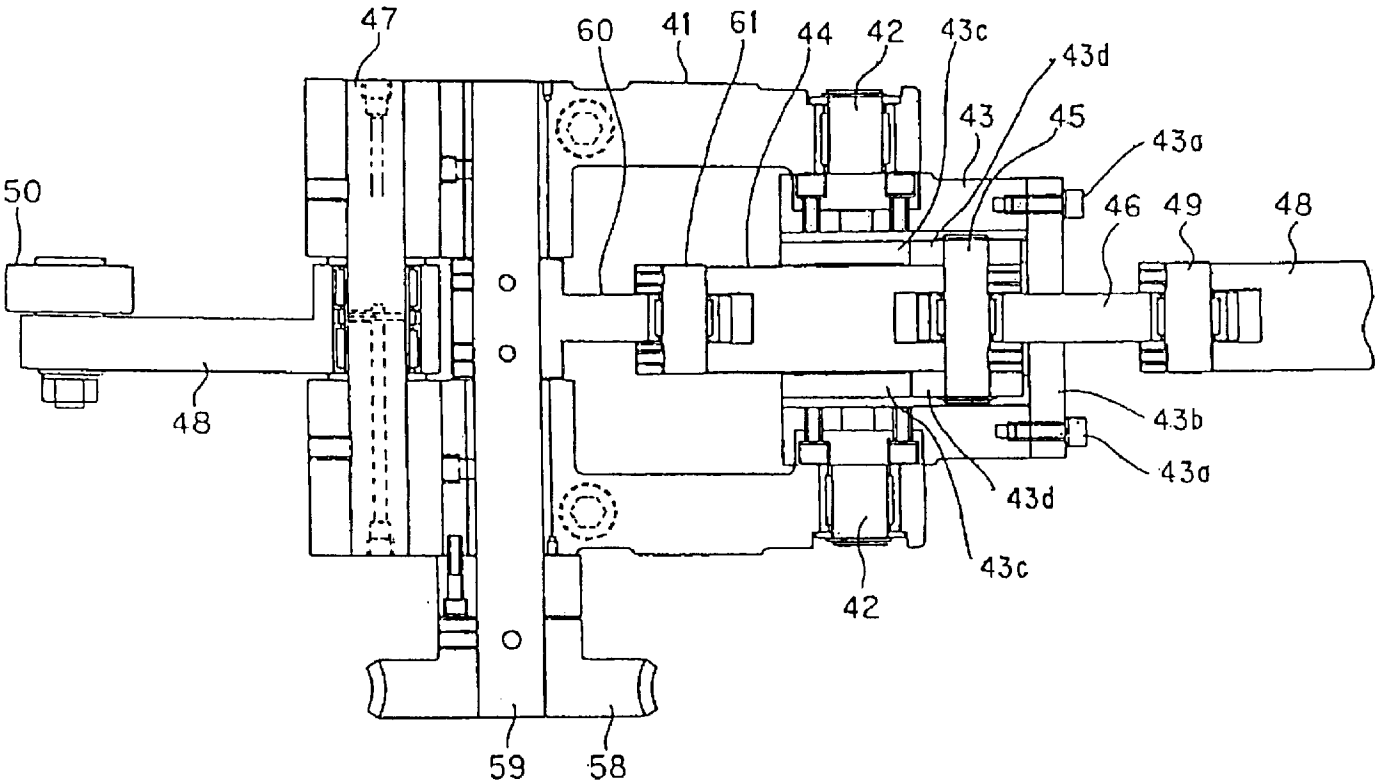
FIG. 6 is a cross sectional developed view of the essential parts of FIG. 3.
Figure 7:
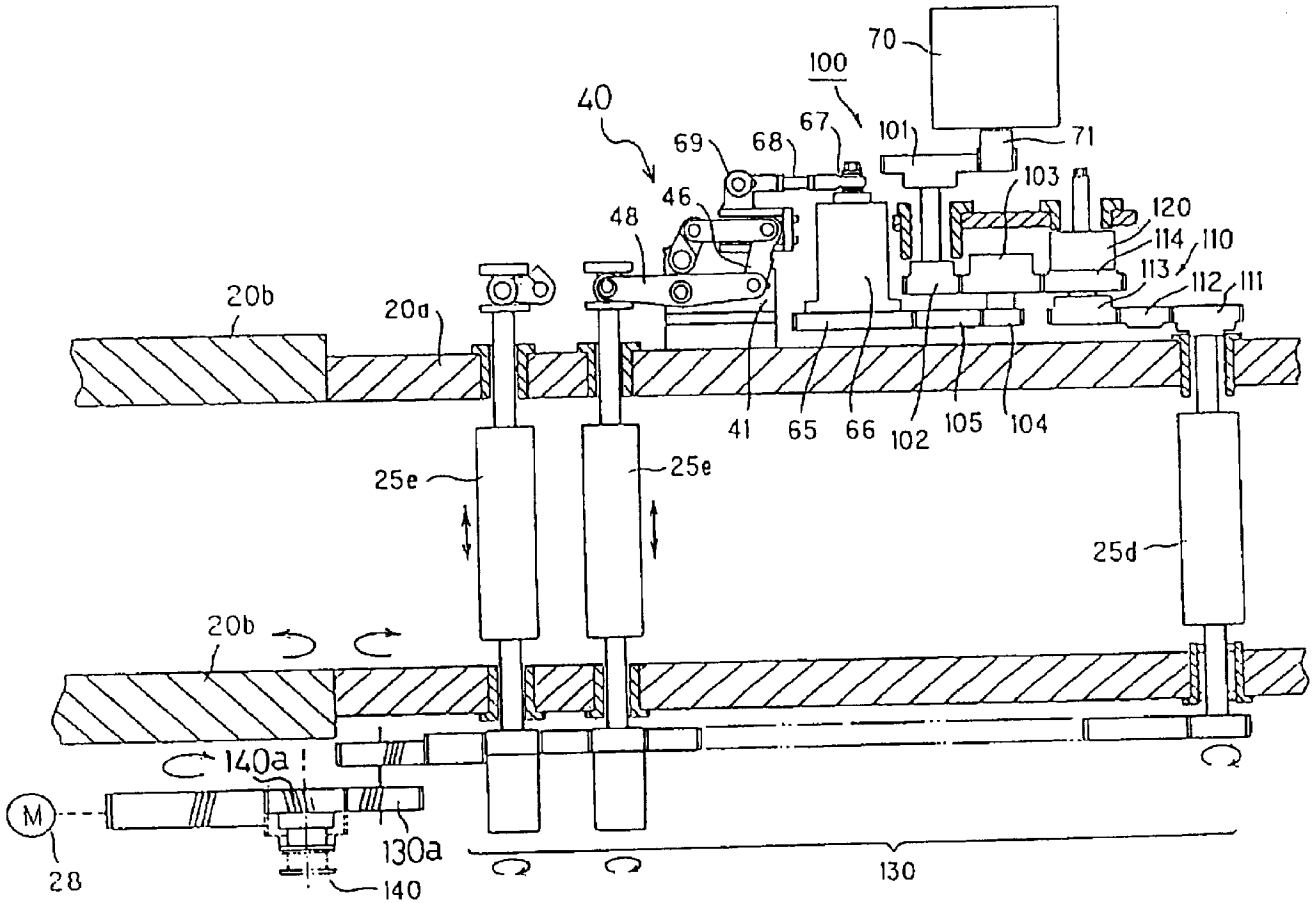
FIG. 7 is a schematic configuration drawing of a driving force transmission mechanism of the inker.
Figure 8:
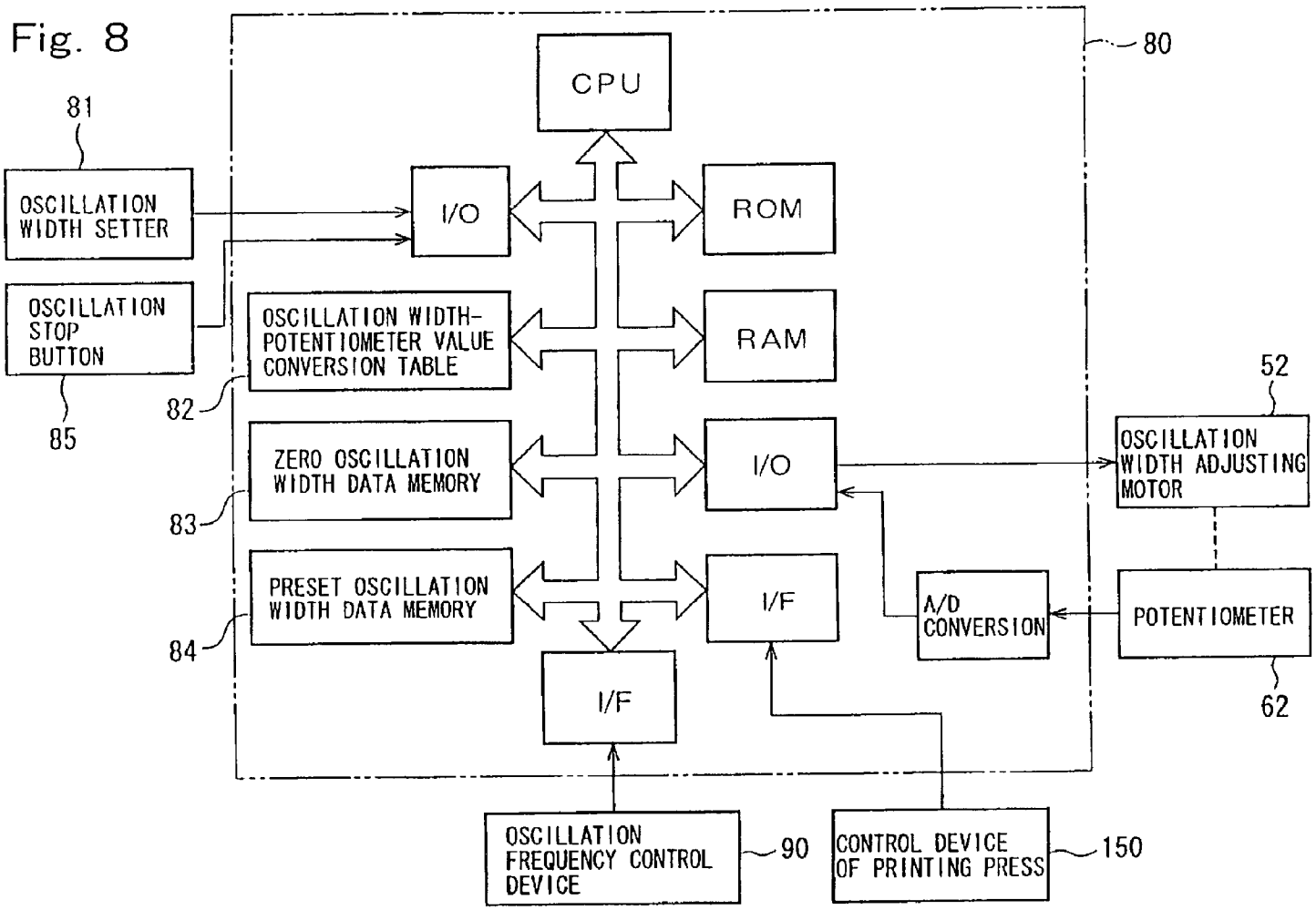
FIG. 8 is a block diagram of an oscillation width control device.
Figure 9:
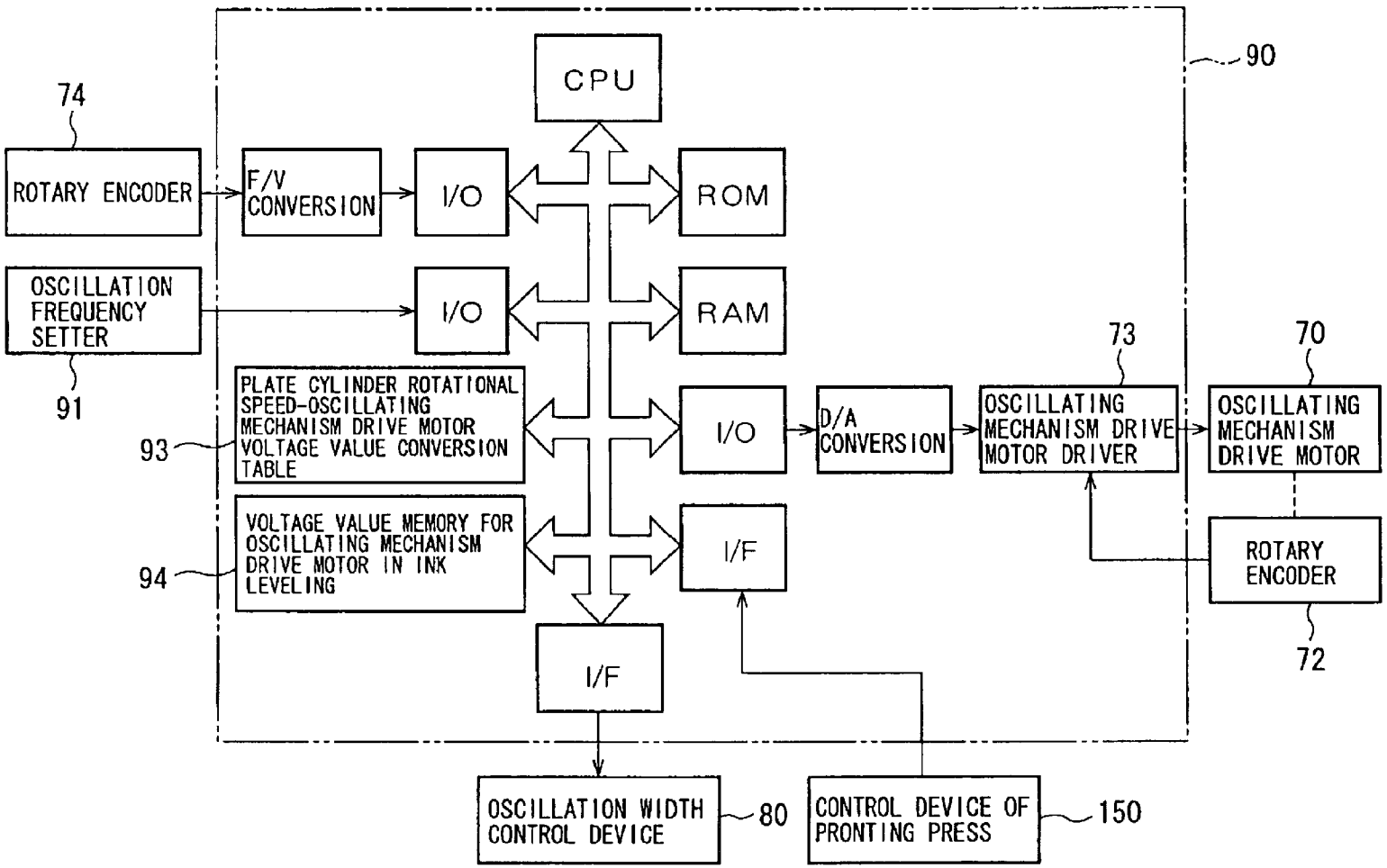
FIG. 9 is a block diagram of an oscillation frequency control device.
Figure 10:
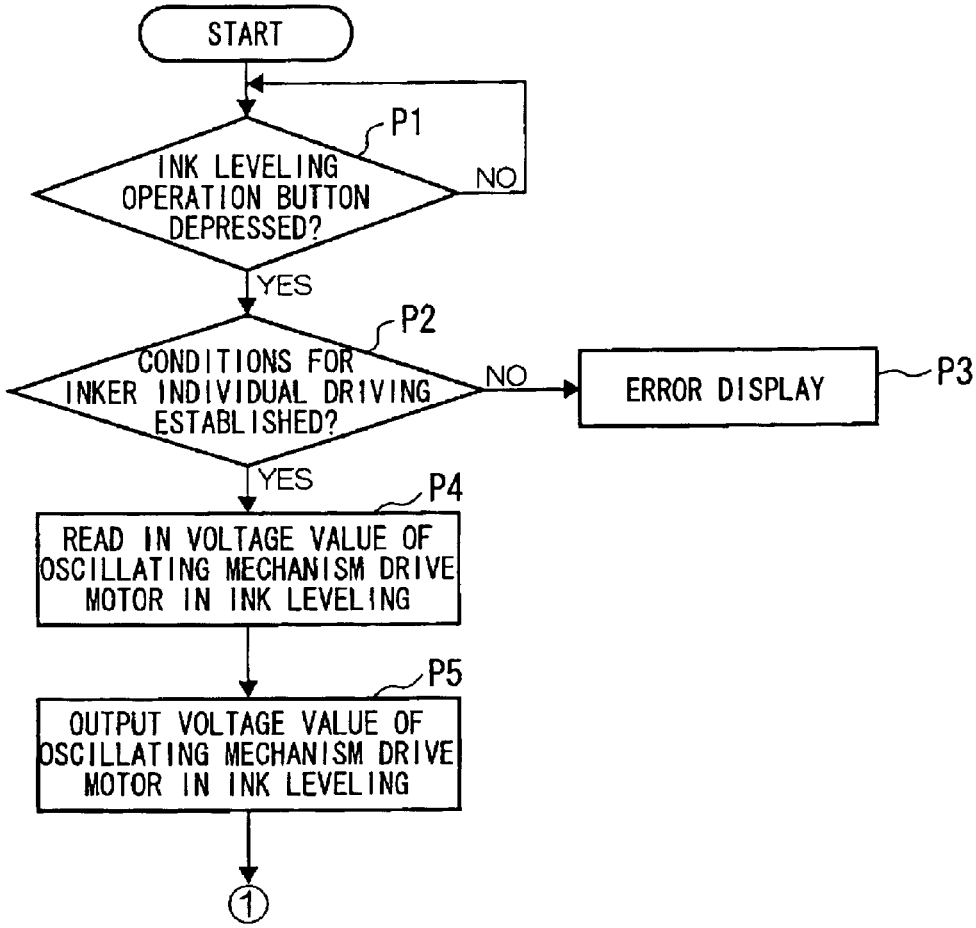
FIG. 10 is a flow chart for oscillation width control during ink conditioning.
Figure 11:
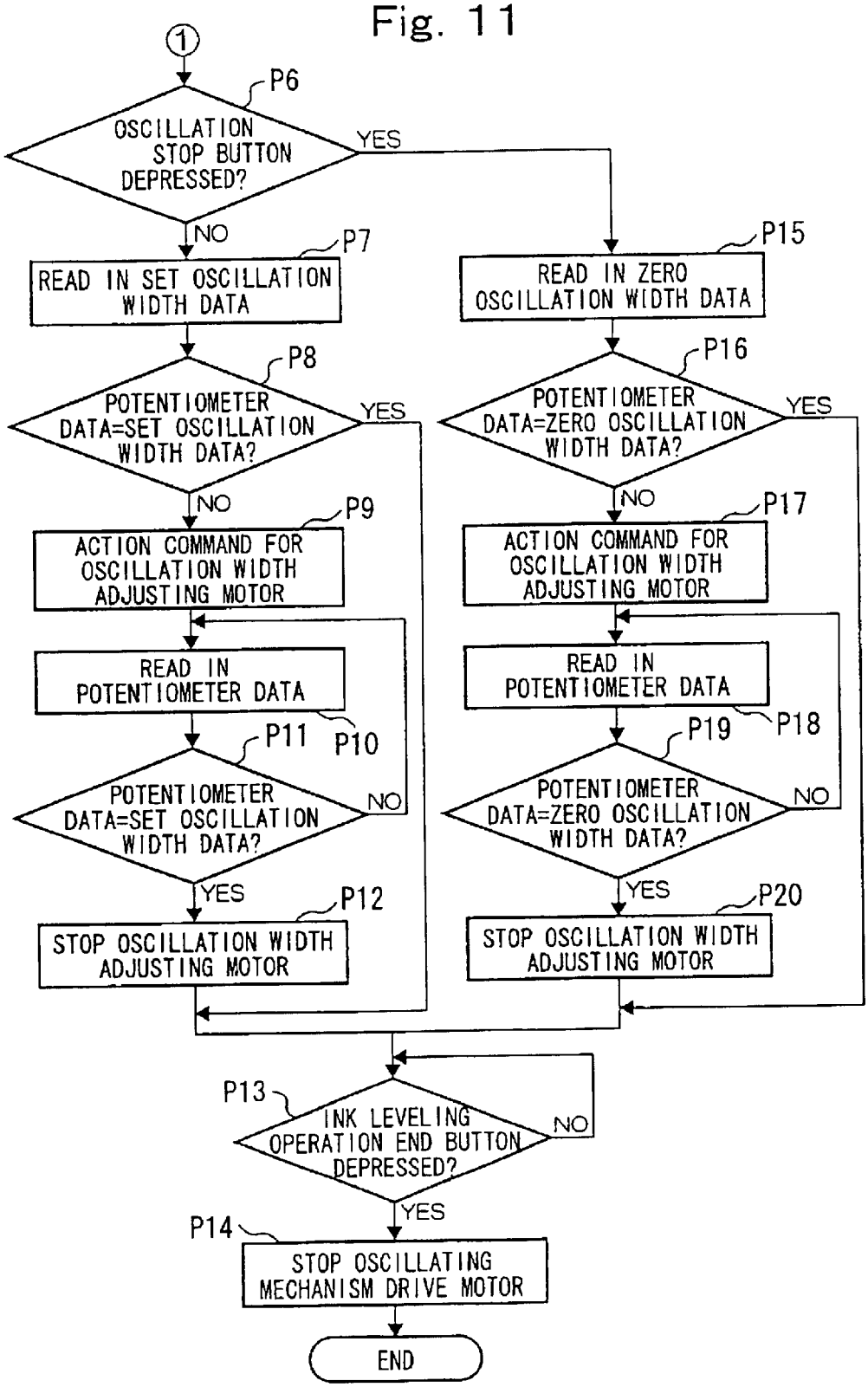
FIG. 11 is a flow chart for oscillation width control during ink conditioning.
Figure 12:
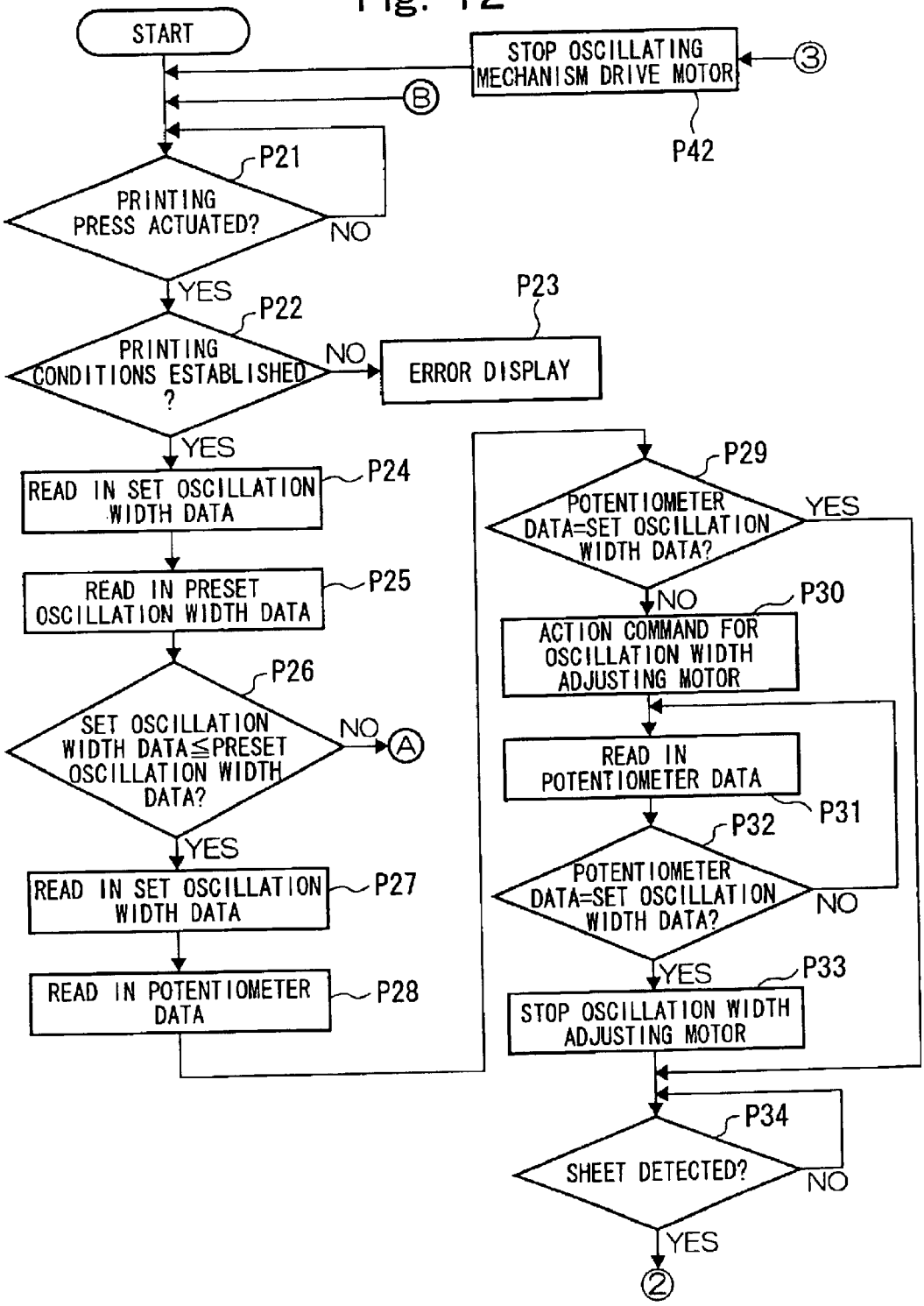
FIG. 12 is a flow chart for oscillation frequency control during printing.
Figure 13:
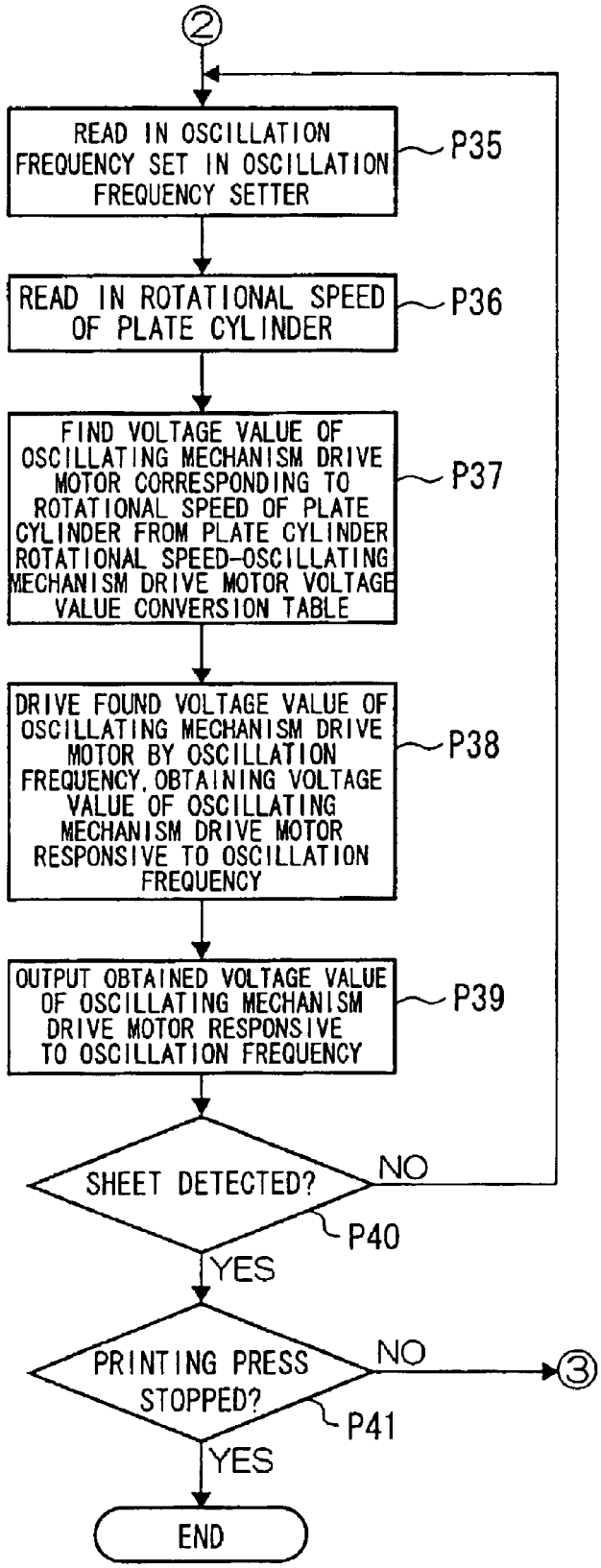
FIG. 13 is a flow chart for oscillation frequency control during printing.
Figure 14:
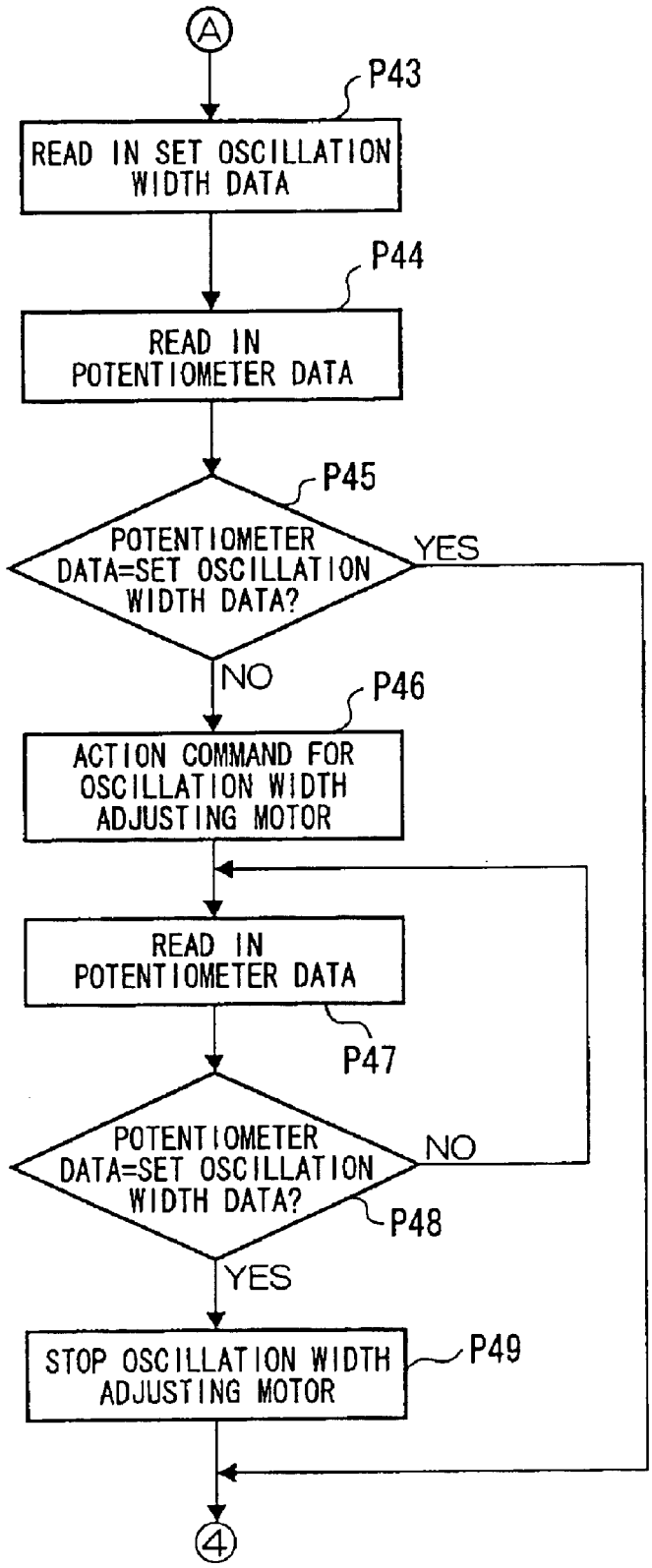
FIG. 14 is a flow chart for oscillation frequency control during printing.
Figure 15:
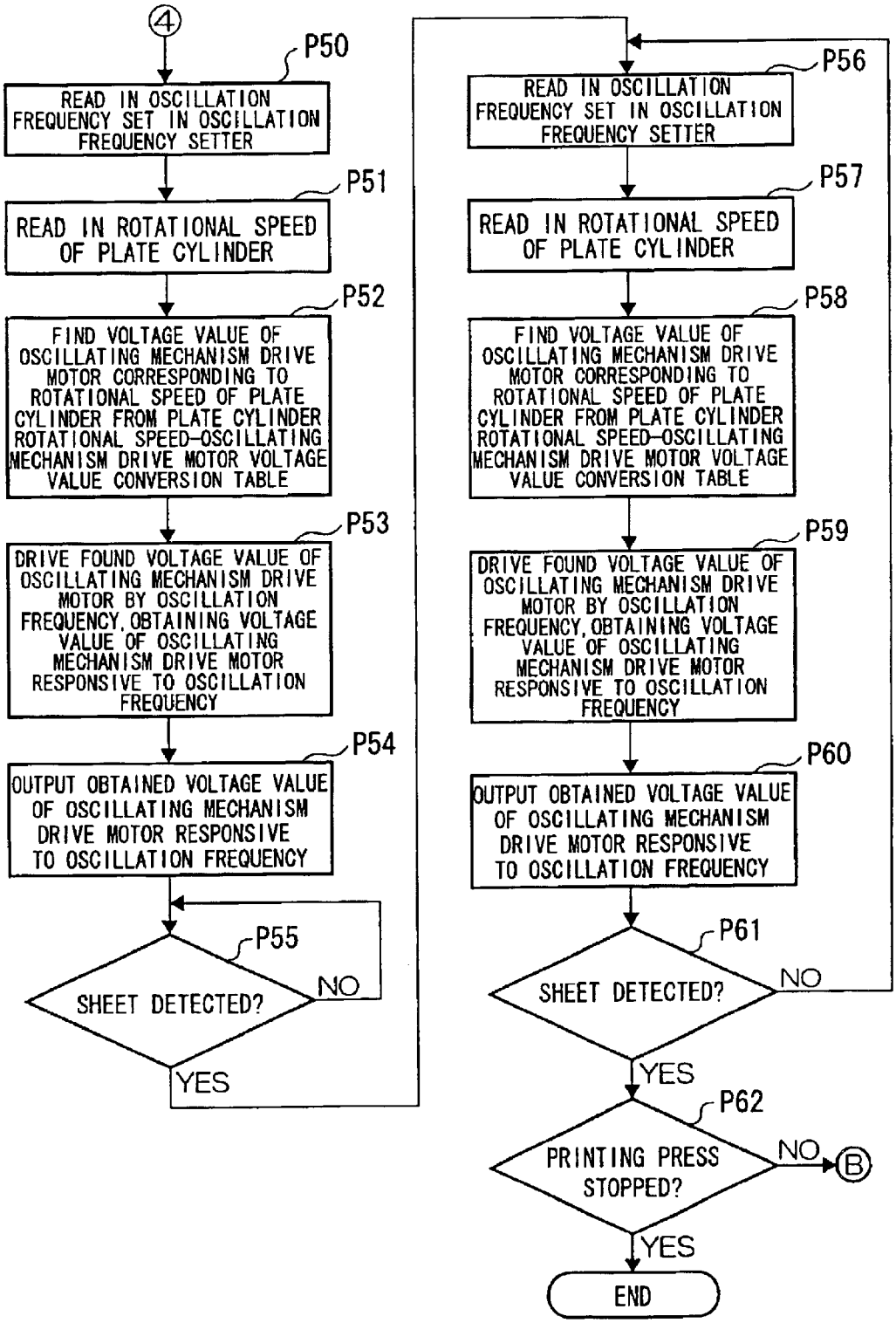
FIG. 15 is a flow chart for oscillation frequency control during printing.

FIGS. 1*a* and 1*b* are an external schematic configuration drawing of a double-sided multicolor offset printing press, and an enlarged view of a hydraulic cylinder, respectively, showing a first embodiment of the present invention. FIG. 2 is an extracted, enlarged view of an inker portion. FIG. 3 is a side sectional view showing a schematic structure of the essential parts of an oscillating mechanism for an oscillating roller. FIG. 4 is a plan view taken along the arrowed line IV of FIG. 3. FIG. 5 is a front view taken along the arrowed line V of FIG. 4. FIG. 6 is a cross sectional developed view of the essential parts of FIG. 3. FIG. 7 is a schematic configuration drawing of a driving force transmission mechanism of the inker. FIG. 8 is a block diagram of an oscillation width control device. FIG. 9 is a block diagram of an oscillation frequency control device. FIGS. 10 and 11 are flow charts for oscillation width control during ink conditioning. FIGS. 12 and 13 are flow charts for oscillation frequency control during printing. FIGS. 14 and 15 are flow charts for oscillation frequency control during printing.

As shown in FIG. 1*a*, a feeder pile board 11 is provided in a feeder 10. In the feeder 10, a feeder board 12 is provided for feeding sheets 1 on the feeder pile board 11 to a printing unit 20 one by one. At the front end of the feeder board 12, a swing arm shaft pregripper 13 is provided for passing the sheet 1 on to a transfer cylinder 21*a* of the printing unit 20.

The transfer cylinder 21*a* contacts an impression cylinder 22*a*, having a rubber blanket mounted on an outer peripheral surface thereof, via transfer cylinders 21*b* to 21*d*. A blanket cylinder 22*b* is in contact with the impression cylinder 22*a* downstream from the transfer cylinder 21*d*. A plurality of (four in the present embodiment) plate cylinders 23*a* are in contact with the impression cylinder 22*a* upstream from the transfer cylinder 21*d* at predetermined spaced intervals in the circumferential direction of the impression cylinder 22*a*. A plurality of (four in the present embodiment) plate cylinders 23*b* are in contact with the blanket cylinder 22*b* upstream from the impression cylinder 22*a* at predetermined spaced intervals in the circumferential direction of the blanket cylinder 22*b*.

A transfer cylinder 24 is in contact with the impression cylinder 22*a* downstream from the blanket cylinder 22*b*. A delivery cylinder 31 of a delivery unit 30 is in contact with the transfer cylinder 24. A sprocket 32 is provided on the delivery cylinder 31 coaxially. In the delivery unit 30, a sprocket 33 is also provided. A delivery chain 34 is looped between the sprockets 32 and 33. In the delivery chain 34, a plurality of delivery grippers (not shown) are provided at predetermined spaced intervals. In the delivery unit 30, delivery pile boards 35*a* and 35*b* for piling the printed sheets 1 are provided.

As shown in FIG. 2, an inker 25 for supplying ink is provided for the plate cylinder 23*a*. The inker 25 includes ink fountains 25*a* for holding ink, ink fountain rollers 25*b* for feeding the ink held within the ink fountains 25*a*, ink ductor rollers 25*c* for withdrawing the ink fed by the ink fountain rollers 25*b*, distribution rollers 25*d* for distributing the withdrawn ink, oscillating rollers 25*e* for leveling the ink in the axial direction by reciprocating in the axial direction, and form rollers 25*f* for supplying the ink to the plate cylinders 23*a*. The same inker 25 as stated above is provided for the plate cylinders 23*b*.

The inker 25 is also provided with a hydraulic cylinder 26 as first engaging/disengaging means, as shown in FIG. 1*b*. The hydraulic cylinder 26 serves as frame moving means which moves the inker 25 from a position indicated by solid lines in FIG. 1*a* to a position indicated by two-dot chain lines, and from the position indicated by the two-dot chain lines to the position indicated by the solid lines. When the inker 25 moves to the position indicated by the two-dot chain lines shown in FIG. 1*a*, the inker 25 is separated from the impression cylinder 22*a* and the plate cylinders 23*a*. Thus, the main unit and the inker 25 are detached from each other as will be described later.

A sensor 27 for detecting an inker frame 20*a* as a second frame is supported on the hydraulic cylinder 26. The sensor 27 enables an electromagnetic clutch 120 (to be described later) to become ON when it does not detect the inker frame 20*a* any more, and permits the electromagnetic clutch 120 not to become ON when it is detecting the inker frame 20*a*. That is, when the inker frame 20*a* and a main unit frame 20*b* as a first frame are close to each other, the clutch 120 cannot become ON.

As shown in FIGS. 3 to 6, a support platform 41 is attached near the shaft end of the oscillating roller 25*e* on the inker frame 20*a* of the printing unit 20. On the support platform 41, there are provided a pair of L-shaped rocking levers 43 each of which has a bend center portion between its front end and its base end rockingly supported by a fulcrum pin 42 so as to be rockable toward and away from the oscillating roller 25*e*. These rocking levers 43 are integrally connected by a plate 43*b* via bolts 43*a*.

Slide grooves 43*c* are formed between the front ends and the bend center portions of the rocking levers 43. Dowels 43*d* are slidably fitted to the slide grooves 43*c* of the rocking levers 43. The dowels 43*d* are supported on end portions of a pin 45. To the pin 45, a front end of a slide lever 44 and one end of a first link plate 46 are connected so as to be pivotable. That is, the front end of the slide lever 44 and the one end of the first link plate 46 are supported by the rocking levers 43 via the pin 45 and the dowels 43*d* so as to be capable of approaching and separating from the fulcrum pin 42.

A base end of a rocking plate 48, which has a portion between its front end and its base end rockingly supported by the support platform 41 via a fulcrum pin 47, is connected to the other end of the first link plate 46 pivotably via a pin 49. A cam follower 50 is attached to the front end of the rocking plate 48. The cam follower 50 is inserted into a sheave 25*ea* provided at the shaft end of the oscillating roller 25*e*. The oscillating roller 25*e* has its shaft end slidably supported so as to be capable of reciprocating along the axial direction.

A casing 51 incorporating an oscillation width adjusting motor 52 as oscillation width adjustment drive means with a brake and capable of normal and reverse rotations is attached to the support platform 41. To a drive shaft of the motor 52, a gear 53 and a drive gear 54 are attached coaxially. The drive gear 54 is in mesh with a transmission gear 55 rotatably supported by the casing 51. To the transmission gear 55, one end of a drive shaft 56 rotatably supported on the support platform 41 via a bracket 41*a* is connected coaxially.

A worm gear 57 is attached to the drive shaft 56 coaxially. A worm wheel 58, which is rotatably supported on the support platform 41, is in mesh with the worm gear 57. One end of a transmission shaft 59, which is rotatably supported on the support platform 41, is connected coaxially to the worm wheel 58. One end of a second link plate 60 is connected and fixed to the transmission shaft 59. The other end of the second link plate 60 is pivotably connected to the base end of the slide lever 44 via a pin 61.

That is, when the motor 52 is driven, the slide lever 44 slidingly moves together with the pin 45 and the dowels 43*d* along the slide grooves 43*c* of the rocking levers 43 via the drive gear 54, transmission gear 55, drive shaft 56, worm gear 57, worm wheel 58, transmission shaft 59, second link plate 60, and pin 61. As a result, the pin 45 of the first link plate 46 is brought toward and away from the fulcrum pin 42, as the rocking center of the rocking levers 43, whereby the distance between the pins 42 and 45 can be adjusted. The oscillation width adjusting motor 52 adjusts the oscillation width to eliminate the distance between the pins 42 and 45, namely, adjusts the pins 42 and 45 to be nearly on the same straight line. By so doing, the oscillation width of the oscillating roller 25*e* is reduced to zero, and the oscillating roller 25*e* cannot reciprocate any more.

A potentiometer 62 is provided within the casing 51. A gear 63 is coaxially attached to an input shaft of the potentiometer 62, and the gear 63 is in mesh with the gear 53. That is, when the motor 52 is driven, the gear 53 is rotated, and its amount of rotation is detected by the potentiometer 62 via the gear 63. That is, the distance between the pins 42 and 45 can be detected.

On a portion of the inker frame 20*a* near the support platform 41, the base end of a support shaft 64 having an axis headed along the axial direction of the oscillating roller 25*e* is rotatably cantilevered. A transmission gear 65 is coaxially attached to a portion of the support shaft 64 close to the inker frame 20*a*. A rotating drum 66 is coaxially attached to a front end portion of the support shaft 64.

To one end surface of the rotating drum 66, a universal joint 67 is attached in an offset state with respect to the axial position of the rotating drum 66. A base end of a shaft 68 is connected to the universal joint 67. A front end of the shaft 68 is connected to the base ends of the rocking levers 43 via a universal joint 69.

The transmission gear 65 is in mesh with a drive gear 71 of an oscillating mechanism drive motor 70 as oscillating mechanism drive means via a gear train 100, as shown in FIG. 7.

That is, the oscillating mechanism drive motor 70 is fixedly supported by the inker frame 20*a*, and has its drive gear 71 meshing with an intermediate gear 101. An intermediate gear 102 coaxial and integral with the intermediate gear 101 is in mesh with an intermediate gear 103. Further, an intermediate gear 104 coaxial and integral with the intermediate gear 103 meshes with the transmission gear 65 via an intermediate gear 105.

That is, when the oscillating mechanism drive motor 70 is actuated to rotate the drive gear 71, the rotating drum 66 is rotated via the intermediate gears 101 to 105, transmission gear 65, and support shaft 64. In accordance with the rotations of the rotating drum 66, the universal joint 67 revolves round the rotating drum 66. In accordance with the revolutions of the universal joint 67 round the rotating drum 66, the shaft 68 makes a reciprocating motion along the axial direction. Thus, the front ends of the rocking levers 43 can be rocked about the fulcrum pin 42 via the universal joint 69 and the base ends of the rocking levers 43.

Furthermore, as shown in FIG. 7, a gear train 110 and an electromagnetic clutch (tooth clutch) 120, which is second engaging/disengaging means, are interposed between the intermediate gear 103 and the distribution roller 25*d*.

That is, the distribution roller 25*d*, like the oscillating roller 25*e*, is rotatably supported by the inker frame 20*a*, and has one end attached to a transmission gear 111. The transmission gear 111 is in mesh with one of connecting gears 113 of the electromagnetic clutch 120 via an intermediate gear 112. The electromagnetic clutch 120 has the connecting gears 113, and a connecting gear 114 coaxial with the connecting gear 113. The connecting gear 114 is in mesh with the intermediate gear 103.

When the electromagnetic clutch 120 is energized, the connecting gear 113 and the connecting gear 114 are electromagnetically attracted and integrated thereby. When the electromagnetic clutch 120 is not energized, the connecting gear 113 and the connecting gear 114 can rotate freely. Thus, when the oscillating mechanism drive motor 70 is actuated with the electromagnetic clutch 120 in an energized state, its rotations are transmitted to the gear trains 100 and 110, and to the distribution roller 25*d* via the gear train 110. The electromagnetic clutch 120 is controlled by a control device 150 of the printing press based on signals from the aforementioned sensor 27 such that it comes into engagement only when the inker 25 is to be individually driven, and becomes disengaged during routine or ordinary printing.

As shown in FIG. 7, the other ends of the plurality of oscillating rollers 25*e* and distribution rollers 25*d* are interlocked with each other by a gear train 130, and connected to the main unit via a clutch 140 (the relevant construction is partly omitted in the drawing to avoid complexity). The clutch 140 always engages except when disengaged only during printing in a small number of colors. Hence, as shown in the drawing, a driving force is transmitted from a drive motor 28, as main drive means, of the main unit to the oscillating rollers 25*e* and distribution rollers 25*d* via the clutch 140 and the gear train 130 to rotate these rollers 25*e* and 25*d*. A gear train (not shown) is provided between the drive motor 28 and the clutch 140. Via this gear train, the driving force from the drive motor 28 of the main unit is transmitted to the cylinders such as transfer cylinders 21*a* to 21*d*, impression cylinders 22*a*, 22*b*, plate cylinders 23*a*, 23*b* and transfer cylinder 24 to drive these cylinders rotationally.

When the inker 25 is brought apart up to the position indicated by the two-dot chain lines shown in FIG. 1*a* by the hydraulic cylinder 26, the inker frame 20*a* supporting the distribution rollers 25*d* and oscillating rollers 25*e* is separated from the main unit frame 20*b* supporting the impression cylinder 22*a* and the plate cylinders 23*a*, as shown in FIG. 7. Thus, a gear 130*a* in the gear train 130 of the inker 25 and a gear 140*a* in the clutch 140 of the main unit are disconnected, so that the main unit and the inker 25 can be driven independently.

The hydraulic cylinder 26 for moving the inker 25 is controlled by the control device 150 of the printing press in such a manner as to move the inker 25 to the position indicated by the two-dot chain lines in FIG. 1*a* only when driving the inker 25 individually, and to move the inker 25 into a state of contact of the form rollers 25*f* with the plate cylinders 23*a*, as indicated by the solid lines in FIG. 1*a*, during ordinary printing. The hydraulic cylinder 26 also serves as connecting/disconnecting means for connecting and disconnecting the main unit and the inker 25. Thus, the hydraulic cylinder 26 need not necessarily be one which moves the inker frame 20*a*, but may be one which moves the main unit frame 20*b*, if the connecting and disconnecting functions can be performed.

As shown in FIG. 8, the oscillation width adjusting motor 52 and the potentiometer 62 are connected to an oscillation width control device 80 which controls the amount of rotation of the motor 52 based on signals from the potentiometer 62. An oscillation width setter 81 as oscillation width inputting means, which inputs command signals such as those on the oscillation width of the oscillating roller 25*e*, is connected to the oscillation width control device 80. A conversion table 82 for the oscillation width set by the oscillation width setter 81 versus the value detected by the potentiometer 62 is provided in the oscillation width control device 80. Thus, the oscillation width set by the oscillation width setter 81 is converted by the conversion table 82, and the oscillation width adjusting motor 52 is driven such that the value detected by the potentiometer 62 becomes the converted value.

Furthermore, the oscillation width control device 80 has a zero oscillation width data memory 83 for reducing the oscillation width of the oscillating roller 25*e* to zero (amount of oscillation 0 mm), and a preset oscillation width data memory 84 for presenting a criterion for judgment of whether printing is rainbow printing or not. To the oscillation width control device 80, there are also connected an oscillation stop button 85 as a switch provided on an operating panel or the like, and the control device 150 of the printing press which receives signals from the aforementioned sensor 27.

As shown in FIG. 9, the aforementioned oscillating mechanism drive motor 70, and a rotary encoder 72 connected to the oscillating mechanism drive motor 70 are connected to the oscillation frequency (i.e., number of oscillations) control device 90 which controls the motor 70 via a driver 73 based on signals from the rotary encoder 72 while checking the rotational speed of the motor 70.

To the oscillation frequency control device 90, there are connected a rotary encoder 74 for detecting the rotational speed (i.e., number of rotations) of the transfer cylinder 21*a*, namely, the rotational speed of the plate cylinders 23*a*, 23*b*, and an oscillation frequency setter 91 for inputting command signals, such as those on the oscillation frequency of the oscillating roller 25*e*, responsive to the rotational speed of the plate cylinders 23*a*, 23*b*.

Hence, the oscillation frequency control device 90 is adapted to control the oscillating mechanism drive motor 70 based on signals from the rotary encoder 74, while checking signals from the rotary encoder 72, so that the oscillation frequency of the oscillating roller 25*e* will become the designated value inputted by the oscillation frequency setter 91. A conversion table 93 for the rotational speed of the plate cylinders 23*a*, 23*b* detected by the rotary encoder 74 versus the voltage value of the oscillating mechanism drive motor 70 is provided in the oscillation frequency control device 90.

The oscillation frequency control device 90 also includes a voltage value memory 94 for storing the rotational speed of the oscillating mechanism drive motor 70 during ink conditioning. The voltage value memory 94 stores the most preferred voltage value as the rotational speed of the oscillating mechanism drive motor 70 during ink conditioning. This voltage value is read out from the voltage value memory 94, and set in the oscillating mechanism drive motor 70, for ink conditioning, as will be described later. The aforementioned control device 150 of the printing press is connected to the oscillation frequency control device 90.

As shown in FIGS. 8 and 9, the oscillation width control device 80 and the oscillation frequency control device 90 are connected to each other, and the oscillation width control device 80 is adapted to drive the oscillation width adjusting motor 52 via the oscillation frequency control device 90 under conditions under which the interior of the inker 25 is rotating. That is, rotations of the interior of the inker 25 are effected by the oscillating mechanism drive motor 70 during ink conditioning, or by the drive motor 28 during printing. At the time of printing, the oscillating mechanism drive motor 70 is actuated after actuation of the oscillation width adjusting motor 52.

In the present embodiment, an oscillating mechanism is constituted by the support shaft 64, transmission gear 65, rotating drum 66, universal joint 69, support platform 41, fulcrum pin 42, rocking levers 43, slide lever 44, pin 45, first link plate 46, fulcrum pin 47, rocking plate 48, pin 49, and cam follower 50. An oscillation width adjusting mechanism is constituted by the support platform 41, drive gear 54, transmission gear 55, drive shaft 56, worm gear 57, worm wheel 58, transmission shaft 59, second link plate 60, pin 61, and slide lever 44. Furthermore, an oscillating device 40 (see FIGS. 3 and 7) is constituted by the aforementioned oscillating mechanism and the oscillating mechanism drive motor 70 as drive means therefor, and the aforementioned oscillation width adjusting mechanism and the oscillation width adjusting motor 52 as drive means therefor.

According to the present embodiment, as described above, before printing is started, the printing unit 20 including the plate cylinders 23*a*, 23*b* is adjusted on the part of the main unit frame 20*b*. Whereas, on the part of the inker frame 20*a*, the inker frame 20*a* is separated from the main unit frame 20*b*, and the respective members concerned are adjusted, in order to perform ink conditioning. On the part of the inker frame 20*a*, therefore, the electromagnetic clutch 120 is energized such that the oscillating mechanism drive motor 70 is driven to enable rotations and reciprocating motions within the inker 25. In the case of rainbow printing, the oscillation width adjusting motor 52 is controlled to reduce the oscillation width to zero so that the oscillating roller 25*e* does not reciprocate. During printing, on the other hand, a drive is conveyed from the drive motor 28 such that the same rotational speed as that of the printing unit 20 is imparted. Thus, the inker frame 20*a* is brought into contact with the main unit frame 20*b* to deenergize the electromagnetic clutch 120, and the oscillating mechanism drive motor 70 only reciprocates the oscillating roller 25*e*. Hence, in the case of rainbow printing, the oscillating mechanism drive motor 70 is stopped during idling to stop reciprocating motions. That is, what is controlled (an object of control) for stopping the oscillating roller 25*e* differs depending on the state of printing.

In such a double-sided multicolor offset printing press having the oscillating device 40 for the oscillating roller 25*e*, when the sheet 1 is passed from the feeder pile board 11 of the feeder 10 on to the transfer cylinder 21*a* via the feeder board 12 and the swing arm shaft pregripper 13, the sheet 1 is transferred to the impression cylinder 22*a* (having a gripper device; not shown) of the printing unit 20 via the transfer cylinders 21*b* to 21*d*, and is passed between the impression cylinder 22*a* and the blanket cylinder 22*b*.

At this time, inks from the inkers 25 are supplied to the plates on the plate cylinders 23*a* and 23*b*, whereby the inks corresponding to the patterns of the plates of the plate cylinders 23*a* are supplied to the blanket on the circumferential surface of the impression cylinder 22*a*, while the inks corresponding to the patterns of the plates of the plate cylinders 23*b* are supplied to the blanket on the circumferential surface of the blanket cylinder 22*b*. Thus, while the sheet 1 is passing between the cylinders 22*a* and 22*b*, the patterns of the impression cylinder 22*a* are transferred to one side of the sheet 1, and the patterns of the blanket cylinder 22*b* are transferred to the other side of the sheet 1.

The sheet 1 printed in multiple colors on both sides is passed on to the delivery cylinder 31 via the transfer cylinder 24, and is subjected to gripping change by a gripper of the delivery chain 34. Then, the sheet 1 is transported to the delivery pile boards 35*a*, 35*b* for delivery.

In so supplying the inks from the inkers 25 to the plate cylinders 23*a*, 23*b*, the oscillation width and oscillation frequency of the oscillating roller 25*e* are adjusted in the following manner (see the flow charts of FIGS. 10 to 15):

Ink Conditioning

Prior to an operation for ink conditioning, the rod of the hydraulic cylinder 26 is stretched to move the inker 25 to a retreat position (the position indicated by the two-dot chain lines shown in FIG. 1*a*) where the inker 25 is spaced from the plate cylinders 23*a* or 23*b*. Also, the electromagnetic clutch 120 is engaged to switch the driving of the inker 25 from the main unit (drive side) to the oscillating mechanism drive motor 70. Further, the oscillation width and oscillation frequency of the oscillating roller 25*e* are inputted by the oscillation width setter 81 and the oscillation frequency setter 91, respectively. For rainbow printing, the oscillation stop button 85 is depressed (ON). In this manner, the conditions for individual driving of the inker are set before the ink conditioning operation.

During operation, an ink conditioning operation button (not shown) provided on an operating panel or the like is depressed (ON) in Step P1. Then, in Step P2, it is determined whether the conditions for the individual driving of the inker (rod of hydraulic cylinder 26: stretched, electromagnetic clutch 120: ON, oscillation width and oscillation frequency: inputted) have been established. If negative, an error is displayed in Step P3. If affirmative, the voltage value of the oscillating mechanism drive motor 70 in ink conditioning is read in in Step P4. Then, in Step P5, the voltage value of the oscillating mechanism drive motor 70 in ink conditioning is outputted. That is, the oscillating mechanism drive motor 70 is driven at the voltage value during ink conditioning to rotationally drive the respective rollers within the inker 25 at the rotational speed during ink conditioning.

Then, in Step P6, it is determined whether the oscillation stop button 85 is ON or not. If negative, ordinary printing is done. Thus, in Step P7, set oscillation width data is read in. Then, in Step P8, it is determined whether the set oscillation width data is equal to the current data from the potentiometer 62. If affirmative, an ink conditioning operation is performed until an ink conditioning operation end button (not shown) provided on the operating panel or the like is depressed (ON) in Step P13. If negative, the oscillation width adjusting motor 52 is actuated in Step P9. In Step P10, data from the potentiometer 62 is read in. This action is continued until the set oscillation width data is equal to the data from the potentiometer 62 in Step P11. If these data are equal, the oscillation width adjusting motor 52 is stopped in Step P12. In this manner, the oscillation width adjusting motor 52 is actuated such that during the ink conditioning operation, the oscillating roller 25*e* reciprocates with the oscillation width inputted (set) when the inker individual drive conditions were set. Then, in Step P13, the ink conditioning operation is performed until the ink conditioning operation end button is depressed (ON). If it is ON, the oscillating mechanism drive motor 70 is stopped in Step P14.

If the answer is yes in Step P6, rainbow printing is done. Thus, after the zero oscillation width data is read in in Step P15, it is determined in Step P16 whether the zero oscillation width data is equal to the current data from the potentiometer 62. If affirmative, the ink conditioning operation is performed until the ink conditioning operation end button is depressed (ON) in Step P13. If negative, the oscillation width adjusting motor 52 is actuated in Step P17. In Step P18, data from the potentiometer 62 is read in, and this action is continued until the zero oscillation width data is equal to the data from the potentiometer 62 in Step P19. If these data are equal, the oscillation width adjusting motor 52 is stopped in Step P20. In this manner, the oscillation width adjusting motor 52 is actuated such that during the ink conditioning operation, the oscillating roller 25*e* makes no reciprocating motion according to the data read out from the zero oscillation width data memory 83 within the oscillation width control device 80. Then, the process moves on to Steps P13 and P14 as in ordinary printing.

As described above, in ink conditioning, it is determined automatically based on the ON- or OFF-state of the oscillation stop button 85 whether printing to be done is ordinary printing or rainbow printing. In the case of ordinary printing, the oscillating roller 25*e* is oscillated axially with a predetermined oscillation width, whereby ink can be distributed satisfactorily. In the case of rainbow printing, on the other hand, while rotations of the oscillating mechanism drive motor 70 are being maintained, the oscillation width by the oscillation width adjusting motor 52 is adjusted to 0 mm, namely, the oscillating motion of the oscillating roller 25*e* is stopped, whereby changes in the mixed color width can be prevented.

Printing

Prior to an operation for printing, the rod of the hydraulic cylinder 26 is contracted to move the inker 25 to an advance position (the position indicated by the solid lines shown in FIG. 1*a*) where the inker 25 contacts the plate cylinders 23*a* or 23*b*. Also, the electromagnetic clutch 120 is disengaged to switch the driving of the inker 25 from the oscillating mechanism drive motor 70 to the drive motor 28 of the main unit. Moreover, the oscillation width and oscillation frequency of the oscillating roller 25*e* are inputted by the oscillation width setter 81 and the oscillation frequency setter 91. That is, the drive motor 28 rotationally drives the respective rollers within the inker 25 at the predetermined rotational speed adapted for ordinary printing or rainbow printing.

For operation, as shown in FIG. 12, it is determined in Step P21 whether the printing press is active or not. That is, the oscillation frequency control device 90 detects, based on signals from the rotary encoder 74, whether the cylinders, such as transfer cylinders 21*a* to 21*d*, impression cylinder 22*a*, blanket cylinder 22*b*, plate cylinders 23*a*, 23*b*, and transfer cylinder 24, are rotating or not. Then, in Step P22, it is determined whether the printing conditions (rod of hydraulic cylinder 26: contracted, electromagnetic clutch 120: OFF, oscillation width and oscillation frequency: inputted) have been established. If negative, an error is displayed in Step P23. If affirmative, the set oscillation width data is read in in Step P24. Then, in Step P25, the preset oscillation width data is read in.

Then, in Step P26, it is determined whether the set oscillation width data is not more than the preset oscillation width data. If negative, ordinary printing is done, so that the program goes to Step P43 to be described later. If affirmative, rainbow printing is done. Thus, the set oscillation width data is read in in Step P27, and then the current data from the potentiometer 62 is read in in Step P28. Then, in Step 29, it is determined whether the set oscillation width data is equal to the data from the potentiometer 62.

If affirmative in Step P29, the sheet 1 is detected in Step P34, and then the program goes to Step P35 to be described later. In order for the detection means to detect the sheet 1, a feed button (not shown) is depressed in Step P21 to feed the sheet 1 from the feeder 10, and it is detected by a mechanical phase what position the first sheet 1 fed from the feeder 10 is located at. This detection means may, for example, be one which shows that the transfer cylinder 21*c* holds the sheet 1, or may be a sensor which detects the first fed sheet 1 at a position opposed to the transfer cylinder 21*c*. If negative in Step P29, on the other hand, the oscillation width adjusting motor 52 is actuated in Step P30. In Step P31, data from the potentiometer 62 is read in. This action is continued until the set oscillation width data is equal to the data from the potentiometer 62 in Step P32. If these data are equal, the oscillation width adjusting motor 52 is stopped in Step P33. Thus, Steps P27 to P33 are merely designed to change the set oscillation width to the set oscillation width during rainbow printing by actuating the oscillation width adjusting motor 52. In other words, the oscillating mechanism drive motor 70 is not actuated during the actions in Step P21 through Step P33, meaning that the oscillating roller 25*e* is not reciprocated in a state in which rainbow printing is possible.

Then, if the sheet 1 is detected in Step P34, the oscillation frequency set in the oscillation frequency setter 91 is read in in Step P35. Then, in Step P36, the rotational speed of the plate cylinders 23*a*, 23*b* is read in in Step P36. Then, in Step P37, the voltage value of the oscillating mechanism drive motor 70 corresponding to the rotational speed of the plate cylinders 23*a*, 23*b* is found from the conversion table 93 for the rotational speed of the plate cylinder versus the voltage value of the oscillating mechanism drive motor. Then, in Step P38, the found voltage value of the oscillating mechanism drive motor 70 is divided by the oscillation frequency to obtain the voltage value of the oscillating mechanism drive motor 70 responsive to the oscillation frequency. Then, the voltage value of the oscillating mechanism drive motor 70 responsive to the oscillation frequency is outputted in Step P39. That is, it is not until Step P35 through Step P39 that the oscillating mechanism drive motor 70 is actuated, whereby the oscillating roller 25*e* is oscillated with the predetermined oscillation width and oscillation frequency during rainbow printing.

Then, rainbow printing is continued while the sheet 1 is being detected in Step P40. When the sheet 1 is not detected any more, it is determined in Step P41 whether the printing press is to be stopped or not. In other words, while the sheet 1 is being detected by the detection means in Step P40, a printing action goes on, thus repeating Steps P35 to P40. When the sheet 1 is not detected any more by the detection means in Step P40, impression throw-off is carried out in order to prevent printing on the cylinder. In Step P41, it is determined whether the printing press is stopped because the printing press stop button has been depressed after impression throw-off, or whether jamming is occurring on the feeder board. If the printing press is stopped upon depression of the printing press stop button, printing work is finished at this stage. In case of jamming, the oscillating mechanism drive motor 70 is stopped (for prevention of color mixing), because printing being done is rainbow printing, and also the sheet 1 on the feeder board is removed. After removal of the sheet 1, the actions from Step 21 onward are repeated.

If the answer is no in Step P26, ordinary printing is performed. Thus, the set oscillation width data is read in in Step P43, and data from the potentiometer 62 is read in in Step P44. Then, in Step P45, it is determined whether the set oscillation width data is equal to the current data from the potentiometer 62.

If affirmative in Step P45, the program goes to Step P50 to be described later. If negative, the oscillation width adjusting motor 52 is actuated in Step P46. In Step P47, the potentiometer data is read in. This action is continued until the set oscillation width data is equal to the data from the potentiometer 62 in Step P48. If these data are equal, the oscillation width adjusting motor 52 is stopped in Step P49.

Then, in Step P50, the oscillation frequency set in the oscillation frequency setter 91 is read in, whereafter the rotational speed of the plate cylinders 23*a*, 23*b* is read in in Step P51. Then, in Step P52, the voltage value of the oscillating mechanism drive motor 70 corresponding to the rotational speed of the plate cylinders 23*a*, 23*b* is found from the plate cylinder rotational speed-oscillating mechanism drive motor voltage value conversion table 93. Then, in Step P53, the found voltage value of the oscillating mechanism drive motor 70 is divided by the oscillation frequency to obtain the voltage value of the oscillating mechanism drive motor 70 responsive to the oscillation frequency.

Then, the obtained voltage value of the oscillating mechanism drive motor 70 responsive to the oscillation frequency is outputted in Step P54. Then, a make-ready process for ordinary printing is continued with the predetermined oscillation width and oscillation frequency until the sheet 1 is detected in Step P55.

If the sheet 1 is detected in Step P55, the oscillation frequency set in the oscillation frequency setter 91 is read in in Step P56. Then, in Step P57, the rotational speed of the plate cylinders 23*a*, 23*b* is read in. Then, in Step P58, the voltage value of the oscillating mechanism drive motor 70 corresponding to the rotational speed of the plate cylinders 23*a*, 23*b* is found from the plate cylinder rotational speed-oscillating mechanism drive motor voltage value conversion table 93. Then, in Step P59, the found voltage value of the oscillating mechanism drive motor 70 is divided by the oscillation frequency to obtain the voltage value of the oscillating mechanism drive motor 70 responsive to the oscillation frequency.

Then, the voltage value of the oscillating mechanism drive motor 70 responsive to the oscillation frequency is outputted in Step P60. Then, ordinary printing is continued with the predetermined oscillation width and oscillation frequency while the sheet 1 is being detected in Step P61. When the sheet 1 is not detected any more, it is determined in Step P62 whether the printing press should be stopped or not. That is, when the sheet 1 is detected by the detection means in Step P61, the printing action is going on. Thus, Steps P56 to P61 are repeated. When the sheet 1 is not detected by the detection means any more, impression throw-off is carried out in order to prevent printing on the cylinder. In Step P62, it is also determined whether the printing press is stopped because the printing press stop button has been depressed after impression throw-off, or whether jamming is occurring on the feeder board. If the printing press is stopped upon depression of the printing press stop button, printing work is finished at this stage. In case of jamming, the oscillating mechanism drive motor 70 is not stopped, because printing being done is ordinary printing, but the sheet 1 on the feeder board is removed. After removal of the sheet 1, the actions from Step 21 onward are repeated.

As described above, the set oscillation width data and the preset oscillating width data are compared for printing, whereby it is automatically determined whether printing to be done is rainbow printing or ordinary printing. In case of rainbow printing, the oscillation width is adjusted by the oscillation width adjusting motor 52 until the sheet 1 is supplied to the printing unit 20, but the oscillating mechanism drive motor 70 is stopped to make no oscillating motion. Thus, color mixing of inks is prevented from proceeding during operation (idling).

In case of ordinary printing, until the sheet 1 is supplied to the printing unit 20, oscillation width adjustment is made by the oscillation width adjusting motor 52, and then the oscillating motion is performed by the oscillating mechanism drive motor 70 to begin ink conditioning. Thus, from the start of printing when the sheet 1 is supplied to the printing unit 20, printing can be done on the right paper.

Second Embodiment

Figure 16:
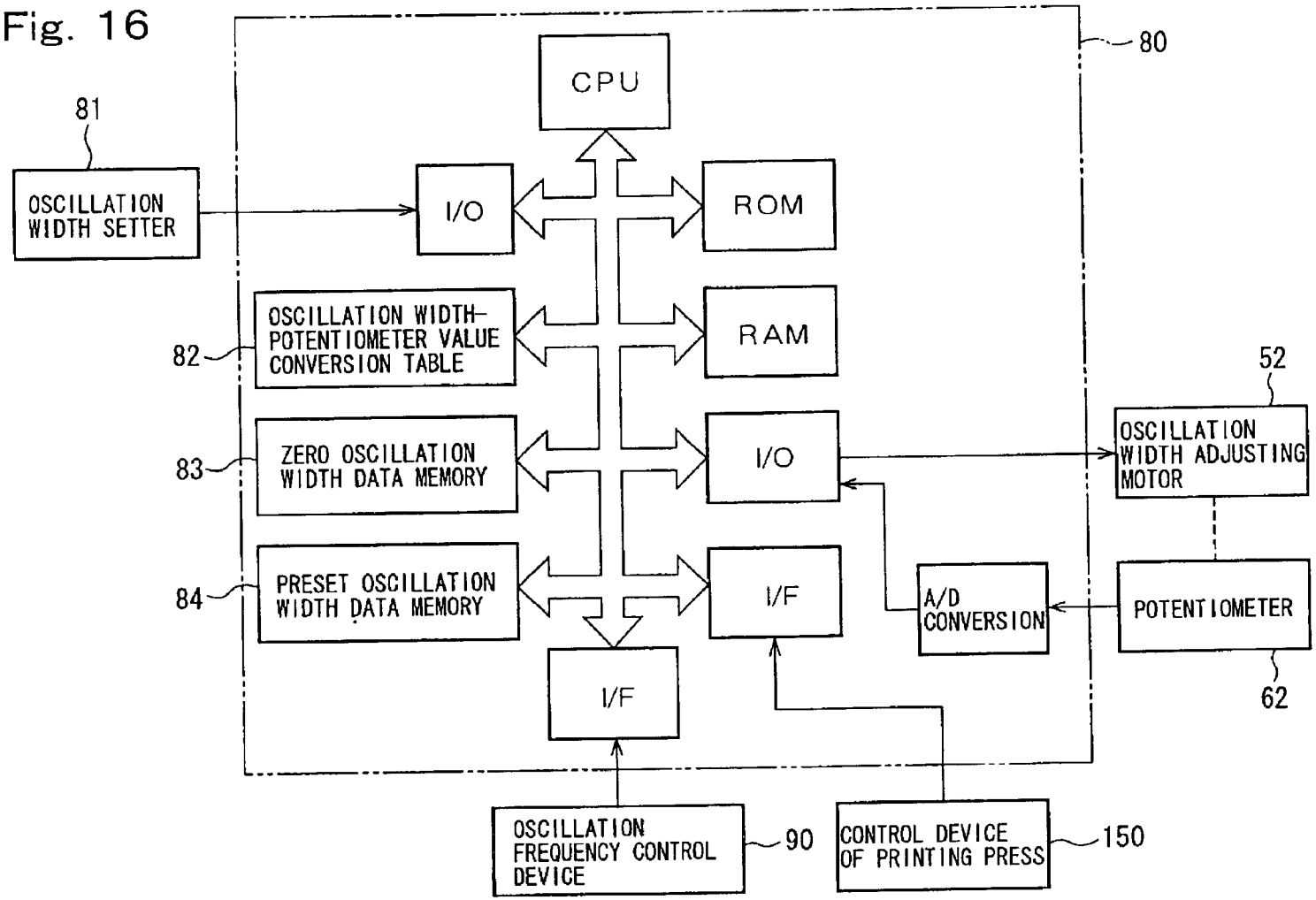
FIG. 16 is a block diagram of an oscillation width control device, showing a second embodiment of the present invention.
Figure 17:
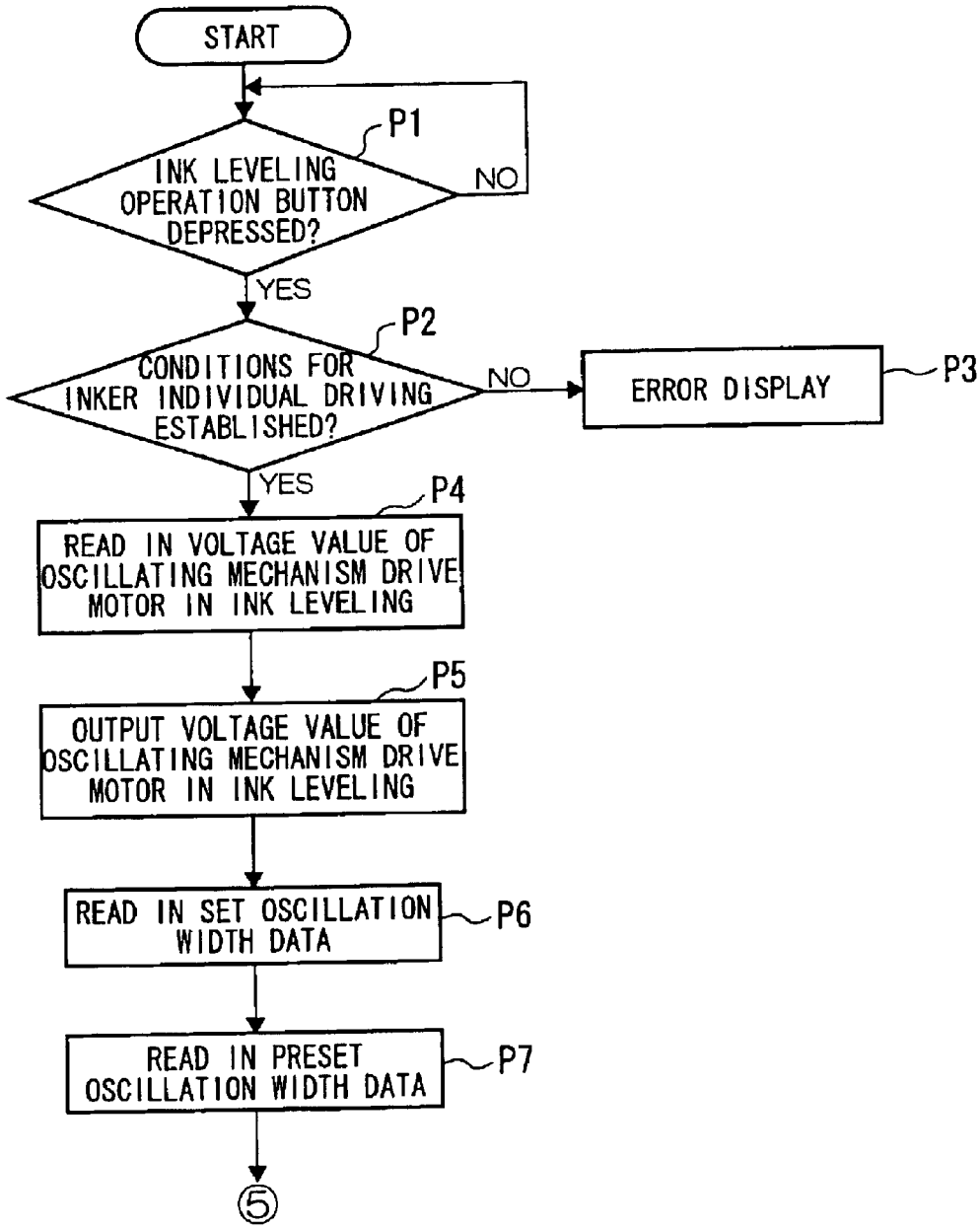
FIG. 17 is a flow chart for oscillation width control during ink conditioning.
Figure 18:
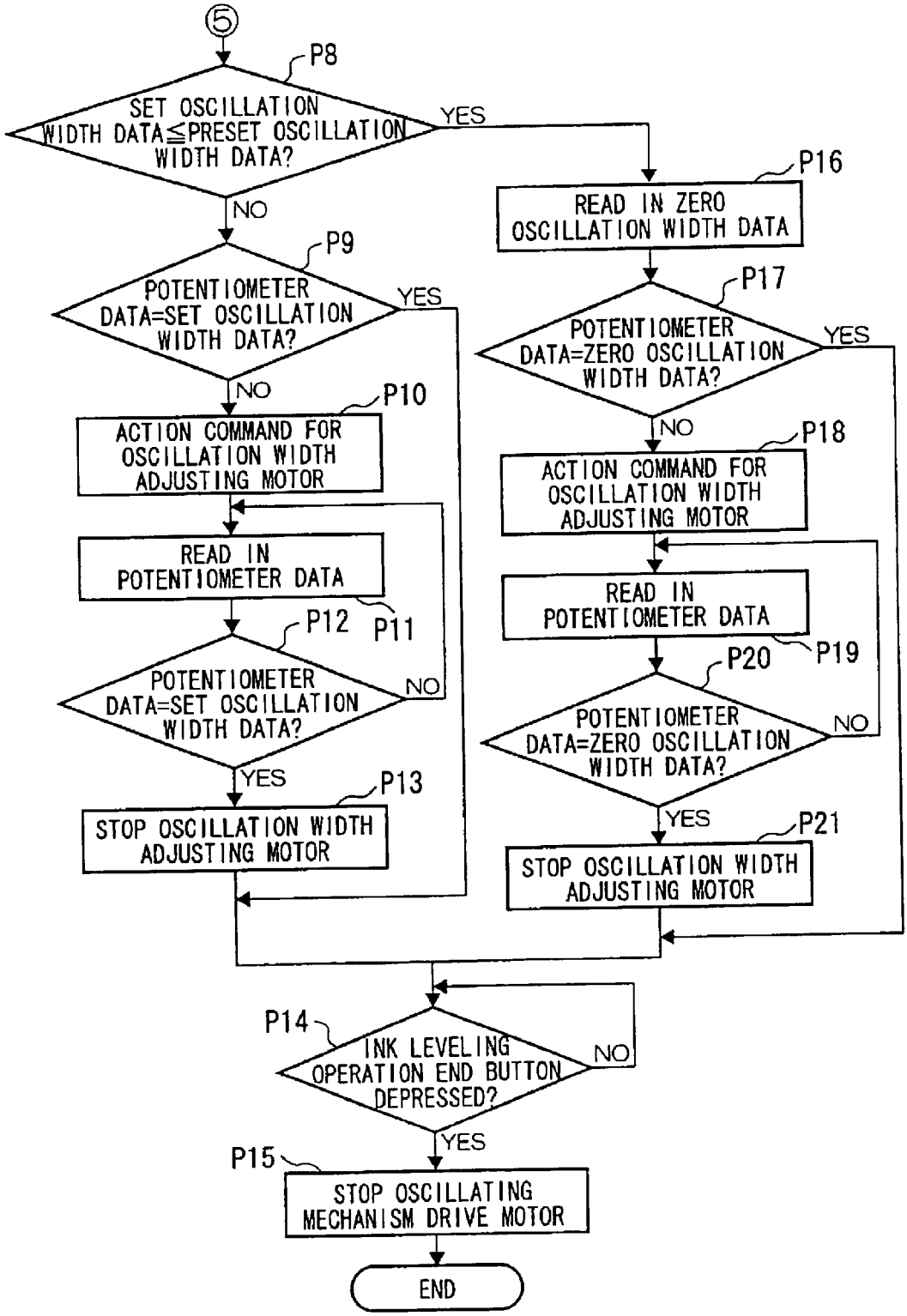
FIG. 18 is a flow chart for oscillation width control during ink conditioning.
Figure 19:
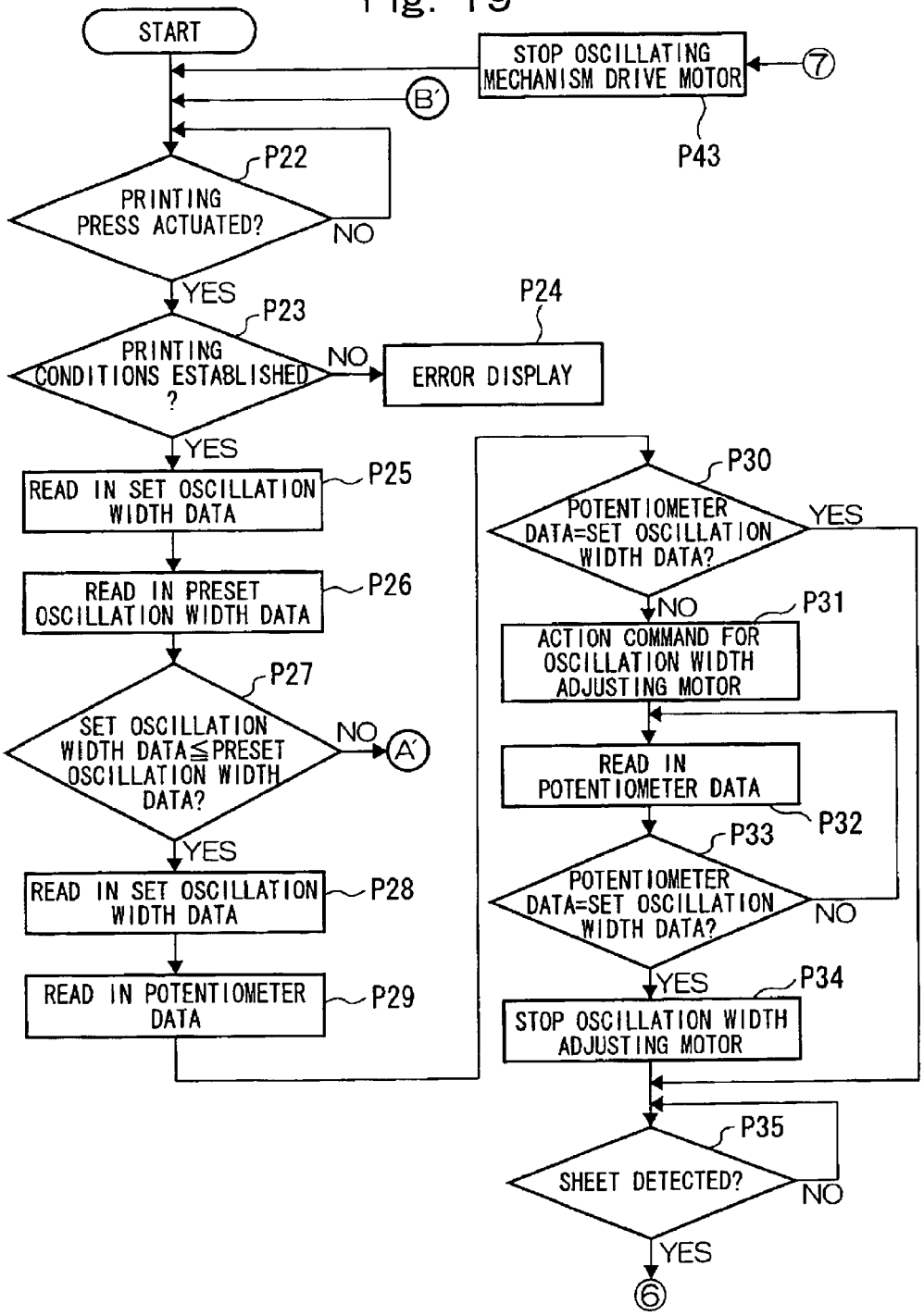
FIG. 19 is a flow chart for oscillation frequency control during printing.
Figure 20:
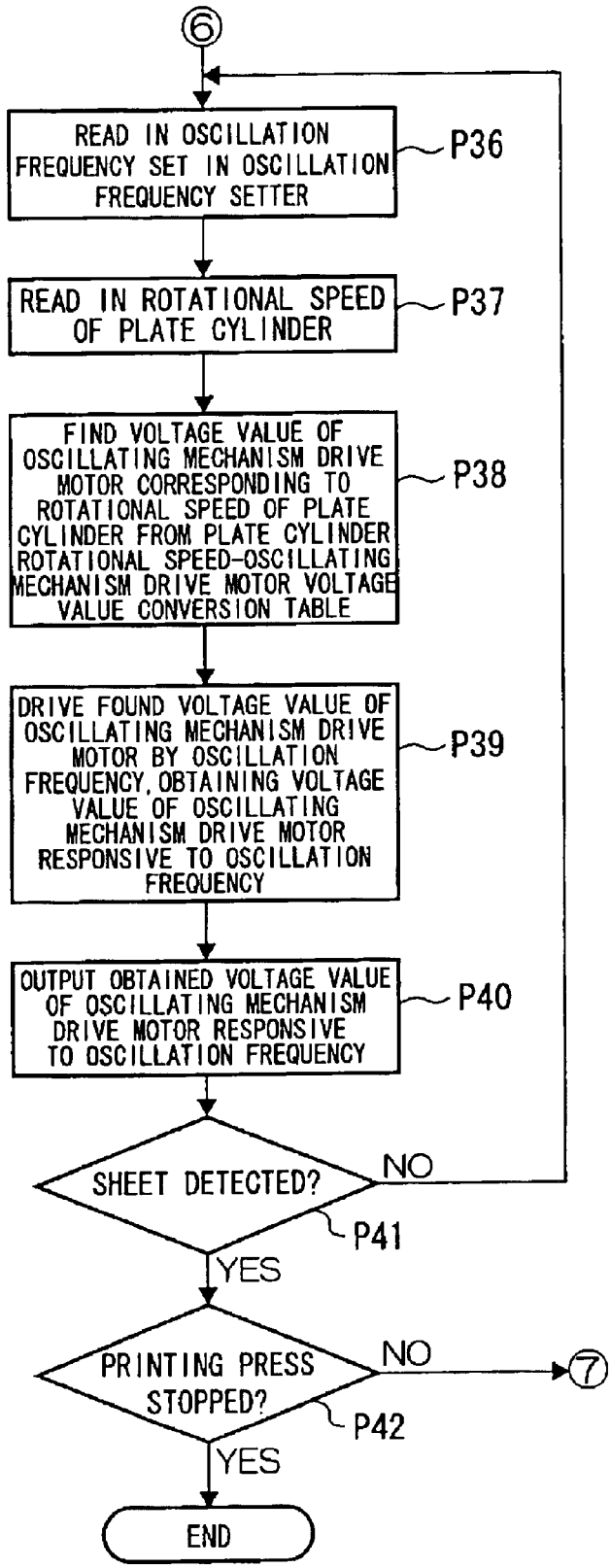
FIG. 20 is a flow chart for oscillation frequency control during printing.
Figure 21:
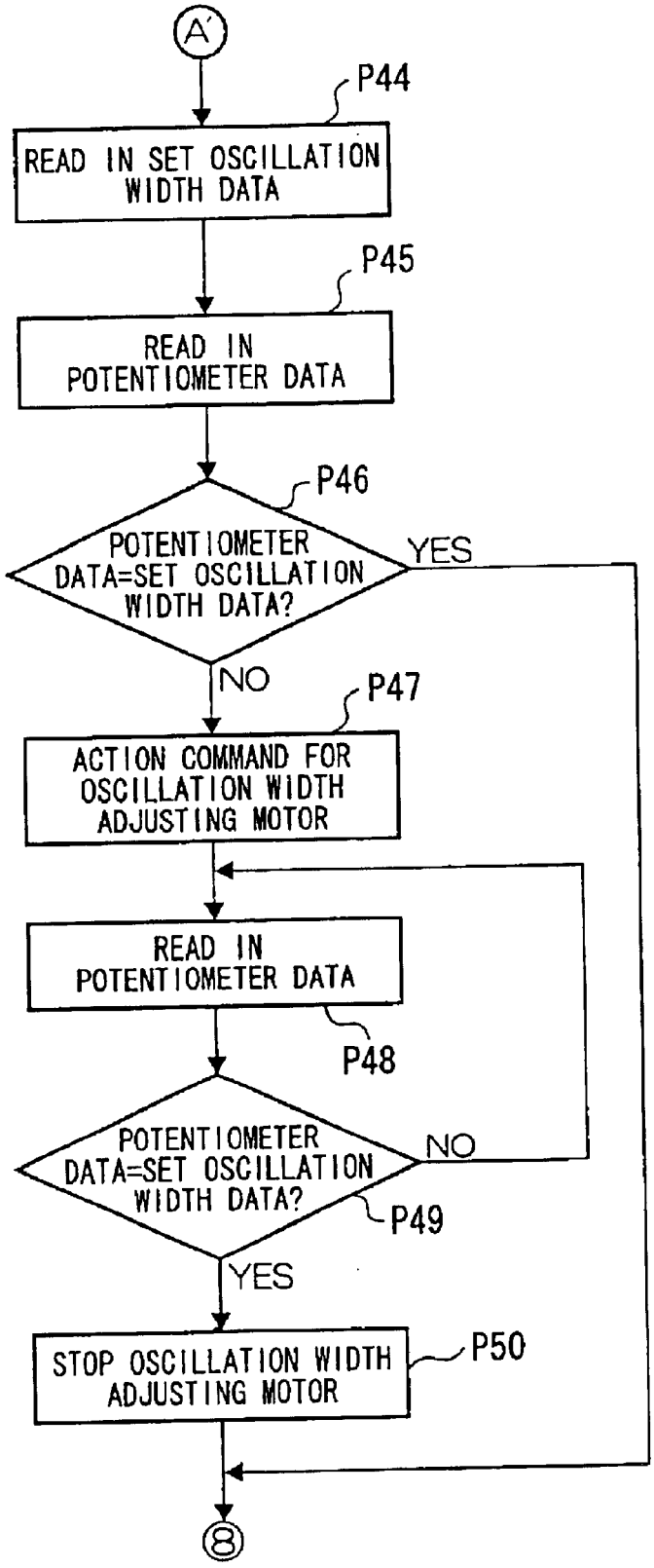
FIG. 21 is a flow chart for oscillation frequency control during printing.
Figure 22:
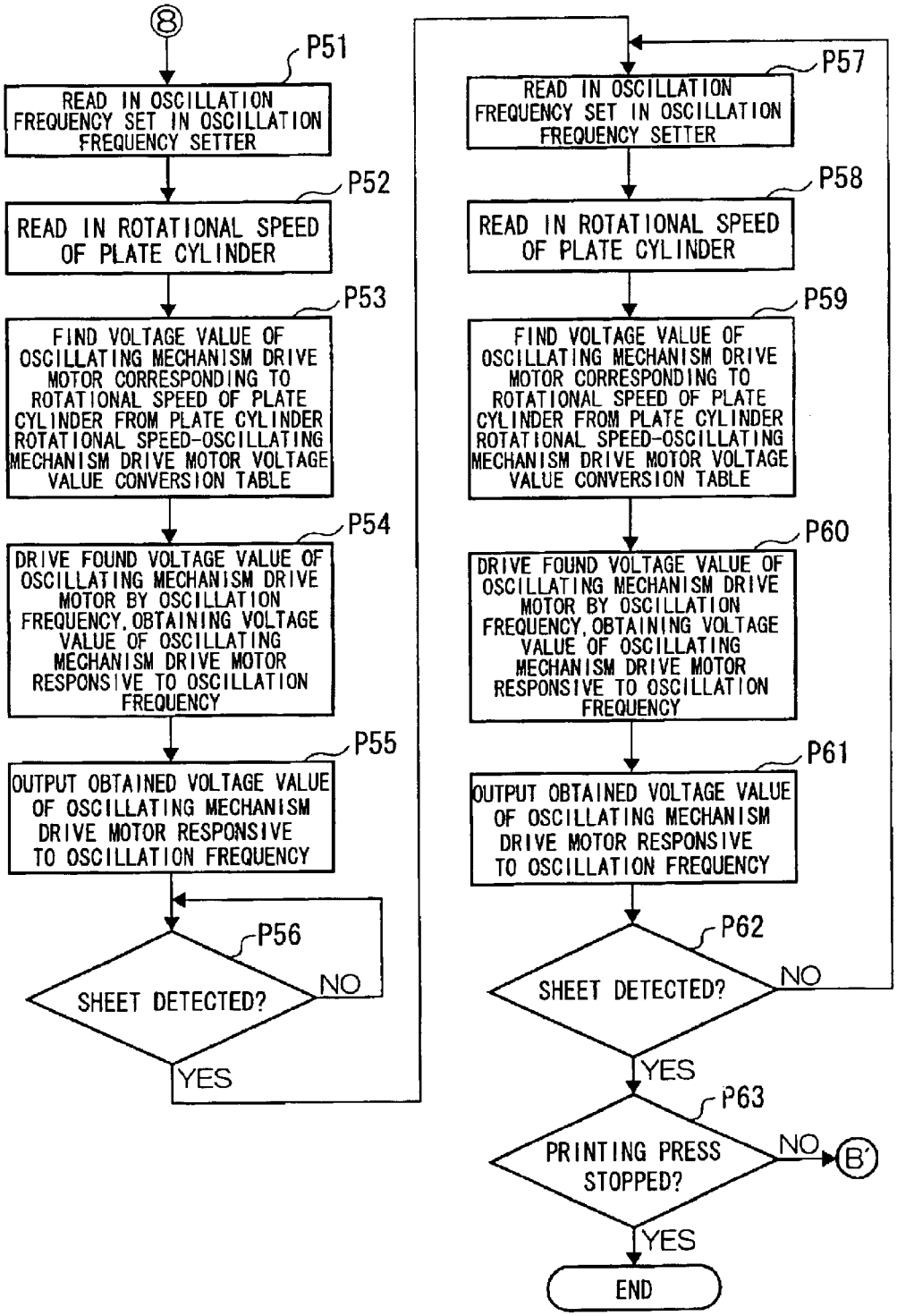
FIG. 22 is a flow chart for oscillation frequency control during printing.

FIG. 16 is a block diagram of an oscillation width control device, showing a second embodiment of the present invention. FIGS. 17 and 18 are flow charts for oscillation width control during ink conditioning. FIGS. 19 and 20 are flow charts for oscillation frequency control during printing. FIGS. 21 and 22 are flow charts for oscillation frequency control during printing.

The present embodiment is an embodiment in which, as shown in FIG. 16 and the flow charts of FIGS. 17 to 22, the oscillation stop button 85 in the first embodiment is abolished, and a determination of whether printing being done during ink conditioning is rainbow printing or ordinary printing is made, as at the time of printing (see Step P27), by determining in Step P8 whether the set oscillation width data read in in Step P6 is equal to or less than the preset oscillation width data read in in Step P7. That is, like the first embodiment, if the set oscillation width data is not more than the preset oscillation width data, it is determined that rainbow printing is being done. Based on this determination, the oscillating motion of the oscillating roller 25*e* is stopped (amount of oscillation=0 mm) during ink conditioning in the printing at issue (see Steps P16 to P21). Other constructions and manners of control are the same as in the first embodiment. Thus, duplicate explanations are omitted.

According to this feature, the oscillation stop button 85 becomes unnecessary, and automation is promoted even further.

While the present invention has been described by the embodiments, it is to be understood that the invention is not limited thereby, but may be varied in many other ways. For example, the printing press having the inker 25 which is movable is taken as an example, but the present invention is applicable to all printing presses, such as a printing press having the printing unit and the inking unit integrated (neither the printing unit nor the inking unit is movable). During rainbow printing, until the sheet 1 is supplied, the oscillating mechanism drive motor 70 is stopped to stop the oscillating motion of the oscillating roller 25*e*. However, the oscillating motion of the oscillating roller 25*e* may be stopped by reducing the oscillation width to zero by the oscillation width adjusting motor 52, while actuating the oscillating mechanism drive motor 70. Also, a construction as in Japanese Patent No. 2875856, in which the lever is restrained by an air cylinder and a pin, may be adopted as means for stopping the oscillating motion of the oscillating roller 25*e*. In the various embodiments, moreover, it is automatically determined whether to stop the reciprocation of the oscillating roller 25*e* for rainbow printing by depressing the oscillation stop button 85 beforehand, and based on this determination, this reciprocation is stopped. However, when a human operator wishes to stop the oscillating roller 25*e* during idling (when not during printing), the oscillation stop button 85 may be depressed to stop the oscillating roller 25*e*. What is important is a construction in which when printing is started during a halt of the reciprocating motion of the oscillating roller, its reciprocating motion is automatically started. Such variations are not to be regarded as a departure from the spirit and scope of the invention, and all such modifications as would be obvious to one skilled in the art are intended to be included within the scope of the appended claims.

What is claimed is:

1. A printing press, comprising:

an oscillating roller capable of rotating circumferentially and capable of moving axially in a reciprocating manner, so that rainbow or ordinary printing can be selected in a printing unit so that a sheet supplied from a feeder can be subjected to said rainbow or said ordinary printing; and a control device exercising control of said oscillating roller, so that for rainbow printing, the axial movement of the oscillating roller is stopped when the printing press is idling, and the oscillating roller is moved axially in a reciprocating manner when printing is started, and for ordinary printing, the oscillating roller is moved axially in a reciprocating manner not only when the printing press is idling, but when printing is started.

2. The printing press of claim 1, further comprising:

an oscillating device for reciprocating said oscillating roller axially, and wherein said control device controls said oscillating device.

3. The printing press of claim, 2, wherein said oscillating device includes, an oscillating mechanism for reciprocating said oscillating roller axially, oscillating mechanism drive means for actuating said oscillating mechanism, an oscillation width adjusting mechanism for adjusting an oscillation width of said oscillating roller, and oscillation width adjustment drive means for actuating said oscillation width adjusting mechanism, wherein said control device controls said oscillation width adjustment drive means such that an oscillation width adjustment amount is reduced to zero, whereby axial movement of said oscillating roller is stopped.

4. The printing press of claim 1, further comprising:

detection means for detecting said sheet being supplied, wherein said control device exercises control, when printing is started, from signals from a detection means.

5. The printing press of claim 1, further comprising:

a switch, wherein said control device controls axial movement of said oscillating roller in response to signals from said switch.

6. The printing press of claim 2, wherein said oscillating device includes an oscillating mechanism for reciprocating said oscillating roller axially, and oscillating mechanism drive means for actuating said oscillating mechanism, wherein said control device stops driving of said oscillating mechanism drive means, thereby stopping axial movement of said oscillating roller.

7. The printing press of claim 2, wherein said oscillating device includes, an oscillating mechanism for reciprocating said oscillating roller axially, oscillating mechanism drive means for actuating said oscillating mechanism, an oscillation width adjusting mechanism for adjusting an oscillation width of said oscillating roller, oscillation width inputting means for inputting the oscillation width of said oscillating roller, wherein a value inputted by said oscillation width inputting means is a designated oscillation width, and oscillation width adjustment drive means for actuating said oscillation width adjusting mechanism, wherein said control device controls actuation of said oscillation width adjustment drive means such that said oscillation width of said oscillating roller is a designated value, and also exercises control to stop said oscillating mechanism drive means while said printing press is idling when said oscillation width designated is smaller than a preset value, whereby axial movement of said oscillating roller is stopped.

8. The printing press of claim 7, wherein said control device actuates said oscillating mechanism drive means while said printing press is idling when said oscillation width designated is larger than the preset value, whereby said oscillating roller is axially moved in an reciprocating manner with said oscillation width designated.

* * * * *